US009418507B2

(12) United States Patent
Palchetti et al.

(10) Patent No.: US 9,418,507 B2
(45) Date of Patent: Aug. 16, 2016

(54) GAMING SYSTEM AND METHOD PROVIDING A GROUP AWARD PRESENTATION OF A PLURALITY OF SIMILAR OR IDENTICAL AWARDS

(75) Inventors: Johnny L. Palchetti, Henderson, NV (US); Dorothy P. Cheung, Reno, NV (US); Kevin M. Kuran, Reno, NV (US)

(73) Assignee: IGT, Las Vegas, NV (US)

( * ) Notice: Subject to any disclaimer, the term of this patent is extended or adjusted under 35 U.S.C. 154(b) by 68 days.

(21) Appl. No.: 13/542,113

(22) Filed: Jul. 5, 2012

(65) Prior Publication Data

US 2014/0011563 A1 Jan. 9, 2014

(51) Int. Cl.
*G07F 17/34* (2006.01)
*G07F 17/32* (2006.01)

(52) U.S. Cl.
CPC ..... *G07F 17/3223* (2013.01); *G07F 17/3213* (2013.01); *G07F 17/3244* (2013.01); *G07F 17/34* (2013.01); *G07F 17/3211* (2013.01)

(58) Field of Classification Search
CPC ..... G07F 17/3211; G07F 17/3213; G07F 17/3223; G07F 17/3244; G07F 17/3267; G07F 17/3269
USPC ..... 463/16–20, 22
See application file for complete search history.

(56) References Cited

U.S. PATENT DOCUMENTS 5,580,053 A 12/1996 Crouch
5,766,074 A 6/1998 Cannon et al.
5,823,873 A 10/1998 Moody
5,902,184 A 5/1999 Bennett
5,911,418 A 6/1999 Adams
5,976,016 A 11/1999 Moody et al.
6,004,208 A 12/1999 Takemoto et al.
6,120,378 A 9/2000 Moody et al.
6,135,884 A 10/2000 Hedrick et al.
6,261,178 B1 7/2001 Bennett
6,336,863 B1 1/2002 Baerlocher et al.
6,358,147 B1 3/2002 Jaffe et al.
6,582,306 B1 6/2003 Kaminkow
6,604,999 B2 8/2003 Ainsworth
6,605,002 B2 8/2003 Baerlocher
6,652,377 B1 11/2003 Moody
6,695,696 B1 * 2/2004 Kaminkow ..... 463/16
6,739,973 B1 5/2004 Lucchesi et al.
6,811,485 B2 11/2004 Kaminkow
6,832,959 B2 12/2004 Baerlocher
6,869,357 B2 3/2005 Adams et al.

(Continued)

*Primary Examiner* — Damon Pierce
(74) *Attorney, Agent, or Firm* — Neal, Gerber & Eisenberg LLP

(57) ABSTRACT

Various embodiments of the present disclosure are directed to a gaming system and method providing a group award presentation of a plurality of similar or identical awards. Generally, the gaming system employs the group award presentation to display a plurality of similar or identical awards for a play of a game as a group rather than separately displaying each individual award. In one embodiment, the group award presentation includes a simultaneous display of the awards associated with a plurality of displayed instances of a winning symbol combination, wherein such awards are simultaneously displayed as a group of awards. In another embodiment, the group award presentation includes a simultaneous display of the awards associated with a plurality of displayed instances of a plurality of winning symbol combinations, wherein such awards are simultaneously displayed as a group of awards, and wherein those winning symbol combinations are associated with a same award.

10 Claims, 14 Drawing Sheets

(56) References Cited

U.S. PATENT DOCUMENTS

| | | | | |
|---|---|---|---|---|
| 6,890,254 | B2 * | 5/2005 | Kaminkow | 463/16 |
| 7,040,982 | B1 | 5/2006 | Jarvis et al. | |
| 7,156,736 | B2 | 1/2007 | Adams et al. | |
| 7,258,613 | B2 | 8/2007 | Lucchesi et al. | |
| 7,311,598 | B2 | 12/2007 | Kaminkow et al. | |
| 7,311,604 | B2 | 12/2007 | Kaminkow et al. | |
| 7,329,182 | B2 | 2/2008 | Adams et al. | |
| 7,338,360 | B2 | 3/2008 | Jarvis et al. | |
| 7,361,088 | B2 | 4/2008 | Maya et al. | |
| 7,393,277 | B2 | 7/2008 | Jackson | |
| 7,413,508 | B2 | 8/2008 | Nelson et al. | |
| 7,427,236 | B2 | 9/2008 | Kaminkow et al. | |
| 7,431,646 | B2 | 10/2008 | Jackson | |
| 7,448,949 | B2 | 11/2008 | Kaminkow et al. | |
| 7,467,999 | B2 | 12/2008 | Walker et al. | |
| 7,481,705 | B2 | 1/2009 | Jarvis et al. | |
| 7,481,710 | B2 * | 1/2009 | Kaminkow | 463/31 |
| 7,488,245 | B2 | 2/2009 | Jarvis et al. | |
| 7,494,411 | B2 | 2/2009 | Baerlocher | |
| 7,494,413 | B2 | 2/2009 | Singer et al. | |
| 7,594,849 | B2 | 9/2009 | Cannon | |
| 7,601,061 | B2 | 10/2009 | Jackson | |
| 7,601,062 | B2 | 10/2009 | Cole et al. | |
| 7,625,280 | B2 | 12/2009 | Singer et al. | |
| 7,666,092 | B2 | 2/2010 | Kaminkow et al. | |
| 7,771,270 | B2 | 8/2010 | Kaminkow et al. | |
| 7,896,734 | B2 | 3/2011 | Kaminkow et al. | |
| 8,016,674 | B2 | 9/2011 | Lucchesi et al. | |
| 2003/0130024 | A1 | 7/2003 | Darby | |
| 2004/0192431 | A1 | 9/2004 | Singer et al. | |
| 2004/0195773 | A1 | 10/2004 | Masci et al. | |
| 2005/0187011 | A1 * | 8/2005 | Kaminkow | 463/20 |
| 2005/0208994 | A1 | 9/2005 | Berman | |
| 2006/0084497 | A1 | 4/2006 | Marks et al. | |
| 2006/0121969 | A1 | 6/2006 | Marks et al. | |
| 2006/0183535 | A1 | 8/2006 | Marks et al. | |
| 2006/0205501 | A1 | 9/2006 | Jarvis et al. | |
| 2007/0026923 | A1 | 2/2007 | Muir | |
| 2008/0070669 | A1 | 3/2008 | Walker et al. | |
| 2008/0070702 | A1 | 3/2008 | Kaminkow et al. | |
| 2008/0108409 | A1 | 5/2008 | Cole et al. | |
| 2008/0146304 | A1 | 6/2008 | Jarvis et al. | |
| 2008/0146311 | A1 | 6/2008 | Walker et al. | |
| 2008/0161096 | A1 | 7/2008 | Jackson | |
| 2008/0182645 | A1 * | 7/2008 | Okada | 463/20 |
| 2008/0274789 | A1 * | 11/2008 | Singer et al. | 463/20 |
| 2009/0042637 | A1 | 2/2009 | Singer et al. | |
| 2009/0124326 | A1 | 5/2009 | Caputo et al. | |
| 2009/0286591 | A1 * | 11/2009 | Singer et al. | 463/20 |
| 2009/0305765 | A1 | 12/2009 | Walker et al. | |

* cited by examiner

GAMING SYSTEM AND METHOD PROVIDING A GROUP AWARD PRESENTATION OF A PLURALITY OF SIMILAR OR IDENTICAL AWARDS

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines that provide players awards in primary or base games are well known. These gaming machines generally require a player to place a wager to activate a play of the primary game. For many of these gaming machines, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in higher awards being provided when they do occur.

For such known gaming machines, an amount of a wager placed on a primary game by a player may vary. For instance, a gaming machine may enable a player to wager a minimum quantity of credits, such as one credit (e.g., one cent, nickel, dime, quarter, or dollar), up to a maximum quantity of credits, such as five credits. The gaming machine may enable the player to place this wager a single time or multiple times for a single play of the primary game. For instance, a gaming machine configured to operate a slot game may have one or more paylines, and the gaming machine may enable a player to place a wager on each of the paylines for a single play of the slot game. Thus, it is known that a gaming machine, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming machines. Such gaming machines usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming machine may initiate or trigger a bonus game when a bonus symbol occurs on the payline on the third reel of a three reel slot machine. The gaming machine generally indicates when a bonus game is initiated or triggered through one or more visual and/or audio output devices, such as the reels, lights, speakers, display screens, etc. Part of the enjoyment and excitement of playing certain gaming machines is the initiation or triggering of a bonus game, even before the player knows an amount of a bonus award won via the bonus game.

In certain jurisdictions, regulations require that all wins or awards for a play of a game be displayed or otherwise indicated to a player prior to initiating a subsequent play of the game for the player. Accordingly, when a player of a gaming system of one of these jurisdictions wins a large quantity of awards for a play of a game, the player must then sit through a time consuming award display process in which each of those awards is individually displayed or otherwise indicated to the player. This award display process substantially slows down game play, tempers the player's excitement, and frustrates the player at a time when the player should enjoy winning such a large quantity of awards.

FIG. 1A illustrates a screen shot of an example gaming system of one such jurisdiction. This example gaming system is configured to operate a slot game including ninety-nine paylines. In this example, when a player of the gaming system wins a large quantity of awards, such as an award associated with each of the ninety-nine paylines, the gaming system must display each individual award to the player. In this example, when the player wins an award associated with each payline, the gaming system must display ninety-nine individual awards to the player. While the player may initially be excited, such as when the gaming system is displaying relatively large awards, the player quickly becomes tired of the process, such as when the gaming system is displaying relatively small or nominal awards. This time consuming process feels like a waste of time to the player when the player could otherwise be enjoying actively playing the game (and potentially winning more awards) rather than passively watching an award display cycle.

One proposed solution is directed to a gaming system configured to simultaneously display the awards associated with a plurality of paylines that pass through a same displayed winning symbol combination. In other words, in this proposed solution, if a winning symbol combination (such as A-A-A) is displayed and two paylines each pass through that winning symbol combination, the gaming system simultaneously displays the awards associated with those two paylines. On the other hand, in this proposed solution, if a first instance of a winning symbol combination is displayed along a first payline and a second instance of that same winning symbol combination is displayed along a second different payline that does not overlap the first payline, the gaming system does not simultaneously display the awards associated with those instances of the winning symbol combination. Rather, the gaming system separately displays the awards associated with those instances of the winning symbol combination. This proposed solution thus does not fully solve the problem described above with respect to FIG. 1A because awards associated with multiple instances of a same winning symbol combination may, in certain instances, not be simultaneously displayed. This proposed solution, therefore, is also time consuming and frustrating to players.

FIGS. 1B and 1C illustrate an example embodiment of this proposed solution. As shown in FIG. 1B, the gaming system displayed an A-A-A winning symbol combination that paylines B and C pass through, and another A-A-A winning symbol combination that payline D passes through. Paylines B and C overlap one another along the A-A-A winning symbol combination displayed along the middle row. Accordingly, as shown in FIG. 1B, the gaming system simultaneously displays the awards associated with paylines B and C. Payline D does not, however, overlap paylines B or C. Thus, the gaming system does not simultaneously display the award associated with payline D along with the awards associated with paylines B and C, even though paylines B, C, and D each pass through instances of the same winning symbol combination. Rather, as illustrated in FIG. 1C, the gaming system separately displays the award associated with payline D. Thus, this example gaming system displays the awards associated certain displayed instances of the same winning symbol combination separately rather than simultaneously.

Accordingly, there is a continuing need to provide a gaming system that employs an improved group award presentation to simultaneously display a plurality of similar or identical awards for a play of a game as a group rather than separately displaying each individual award to further increase game play speed, reduce lulls in game play, and increase player enjoyment and excitement.

SUMMARY

Various embodiments of the present disclosure are directed to a gaming system and method providing a group award presentation of a plurality of similar or identical awards. Generally, the gaming system employs the group award presentation to simultaneously display a plurality of similar or identical awards for a play of a game as a group rather than separately displaying each individual award, which reduces the time the gaming system takes to display the awards to the player and, therefore, increases game play speed. In one embodiment, the group award presentation includes a simultaneous display of the awards associated with a plurality of simultaneously displayed instances of a winning symbol combination of a plurality of different winning symbol combinations, wherein such awards are simultaneously displayed as a group of awards. In another embodiment, the group award presentation includes a simultaneous display of the awards associated with a plurality of simultaneously displayed instances of each of a plurality of winning symbol combinations, wherein such awards are simultaneously displayed as a group of awards, and wherein those winning symbol combinations are associated with a same award.

In operation of certain embodiments, for a play of a game associated with a plurality of symbols, the gaming system displays a plurality of the symbols at a plurality of symbol display areas. The gaming system displays a plurality of different paylines, each of the displayed paylines being associated with a different plurality of the symbol display areas. For each of the displayed paylines, the gaming system determines whether the symbols displayed at the symbol display areas associated with that payline form one of a plurality of winning symbol combinations, each of which is associated with one of a plurality of different awards. Put differently, the gaming system determines whether any of the winning symbol combinations are displayed in association with any of the displayed paylines.

In various embodiments, for a play of the game, the gaming system employs a group award presentation to simultaneously display the awards associated with each of a plurality of instances of a winning symbol combination simultaneously displayed in association with a plurality of paylines. That is, in such embodiments, the gaming system employs the group award presentation to simultaneously display such awards as a group rather than separately displaying each individual award.

In one such embodiment, if a plurality of instances of one of the winning symbol combinations are simultaneously displayed in association with a plurality of the displayed paylines, the gaming system displays a group award presentation associated with that winning symbol combination. In this embodiment, the displayed group award presentation associated with that winning symbol combination includes a display of: (a) the award associated with that winning symbol combination, (b) a quantity of the instances of that winning symbol combination simultaneously displayed in association with the plurality of the displayed paylines, and (c) an indication of the displayed symbols of those simultaneously displayed instances of that winning symbol combination. Put differently, the displayed group award presentation associated with that winning symbol combination includes a display of: (a) the award associated with that winning symbol combination, (b) how many instances of that winning symbol combination are simultaneously displayed in association with the plurality of the displayed paylines, and (c) an indication of which displayed symbols are part of those simultaneously displayed instances of that winning symbol combination. It should thus be appreciated that, in this embodiment, each winning symbol combination is associated with its own group award presentation.

In this embodiment, the gaming system displays the group award presentation associated with a winning symbol combination instead of separately displaying each individual award associated with each of a plurality of instances of that winning symbol combination simultaneously displayed in association with a plurality of the displayed paylines. In this embodiment, the gaming system employs the group award presentation to simultaneously display the awards associated with all simultaneously displayed instances of that winning symbol combination regardless of the symbol display areas at which those instances of that winning symbol combination are displayed. Further, in this embodiment, the gaming system displays the group award presentation in addition to the displayed paylines.

In other embodiments, for a play of the game, the gaming system employs a group award presentation to simultaneously display the awards associated with each of a plurality of instances of a plurality of winning symbol combinations simultaneously displayed in association with a plurality of paylines, wherein those winning symbol combinations are each associated with a same award. That is, in such embodiments, the gaming system employs the group award presentation to simultaneously display such awards as a group rather than separately displaying each individual award.

In one such embodiment, a plurality of the winning symbol combinations are associated with a same one of the awards. For that award, if a plurality of instances of the winning symbol combinations associated with that award are simultaneously displayed in association with a plurality of the displayed paylines, the gaming system displays a group award presentation associated with that award. In this embodiment, the displayed group award presentation associated with that award includes a display of: (a) that award, (b) a quantity of the instances of those winning symbol combinations simultaneously displayed in association with the plurality of the displayed paylines, and (c) an indication of the displayed symbols of those simultaneously displayed instances of those winning symbol combinations. Put differently, the displayed group award presentation associated with that award includes a display of: (a) that award itself, (b) how many instances of the winning symbol combinations associated with that award are simultaneously displayed in association with the plurality of the displayed paylines, and (c) an indication of which displayed symbols are part of those simultaneously displayed instances of those winning symbol combinations. It should thus be appreciated that, in this embodiment, each award is associated with its own group award presentation.

In this embodiment, the gaming system displays the group award presentation associated with an award instead of separately displaying each individual award associated with each of a plurality of instances of a plurality of winning symbol combinations associated with that award that are simultaneously displayed in association with a plurality of the displayed paylines. In this embodiment, the gaming system employs the group award presentation to simultaneously display the awards associated with all simultaneously displayed instances of those winning symbol combinations regardless of the symbol display areas at which those instances of those winning symbol combinations are displayed. Further, in this embodiment, the gaming system displays the group award presentation in addition to the displayed paylines.

Thus, in various embodiments, the gaming system of the present disclosure is configured to employ group award presentations to simultaneously display a plurality of similar or identical awards for a play of a game as a group rather than separately displaying each individual award. This increases game play speed, reduces lulls in game play, and increases player enjoyment and excitement. Further, in various embodiments, unlike the proposed solution discussed above, the gaming system of the present disclosure simultaneously displays the awards associated with all displayed instances of the same winning symbol combination.

Additional features and advantages are described herein, and will be apparent from, the following Detailed Description and the Figures.

DETAILED DESCRIPTION

Group Award Presentation of a Plurality of Similar or Identical Awards

Various embodiments of the present disclosure are directed to a gaming system and method providing a group award presentation of a plurality of similar or identical awards. Generally, the gaming system employs the group award presentation to simultaneously display a plurality of similar or identical awards for a play of a game as a group rather than separately displaying each individual award, which reduces the time the gaming system takes to display the awards to the player and, therefore, increases game play speed. In one embodiment, the group award presentation includes a simultaneous display of the awards associated with a plurality of simultaneously displayed instances of a winning symbol combination of a plurality of different winning symbol combinations, wherein such awards are simultaneously displayed as a group of awards. In another embodiment, the group award presentation includes a simultaneous display of the awards associated with a plurality of simultaneously displayed instances of each of a plurality of winning symbol combinations, wherein such awards are simultaneously displayed as a group of awards, and wherein those winning symbol combinations are associated with a same award.

While the embodiments described below are directed to a primary wagering game, it should be appreciated that the present disclosure may additionally or alternatively be employed in association with a secondary or bonus game. Moreover, while the player's credit balance, the player's wager, and any awards are displayed as an amount of monetary credits or currency in the embodiments described below, one or more of such player's credit balance, such player's wager, and any awards provided to such player may be for non-monetary credits, promotional credits, and/or player tracking points or credits.

In certain embodiments, for a play of a game, the gaming system employs a group award presentation to simultaneously display the awards associated with each of a plurality of instances of a winning symbol combination simultaneously displayed in association with a plurality of paylines. That is, in such embodiments, the gaming system employs the group award presentation to simultaneously display such awards as a group rather than separately displaying each individual award.

Figure 1A:
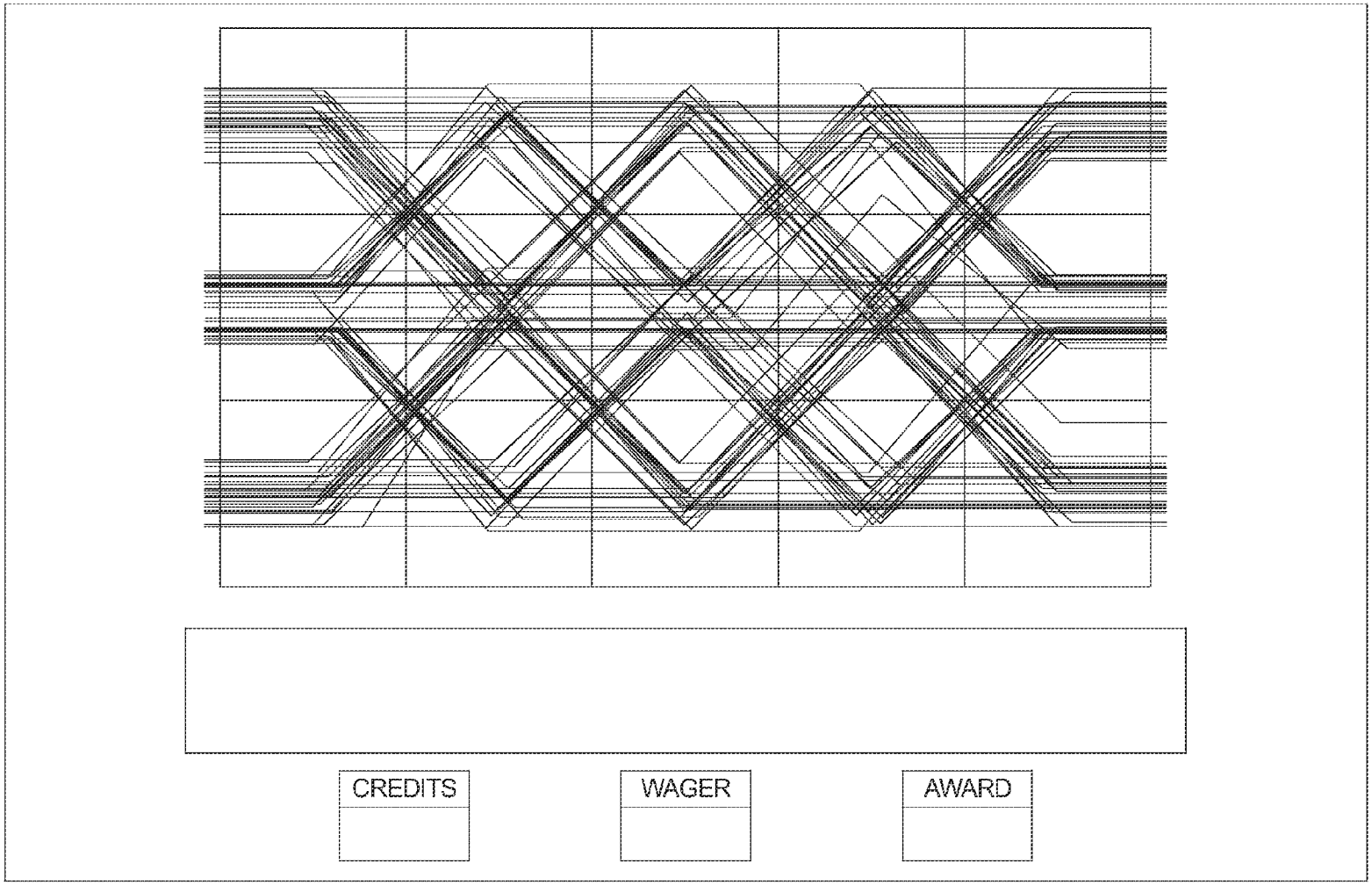
FIG. 1A PRIOR ART
FIG. 1A illustrates a screen shot of an example gaming system configured to operate a slot game including ninety-nine paylines.
Figure 1B:
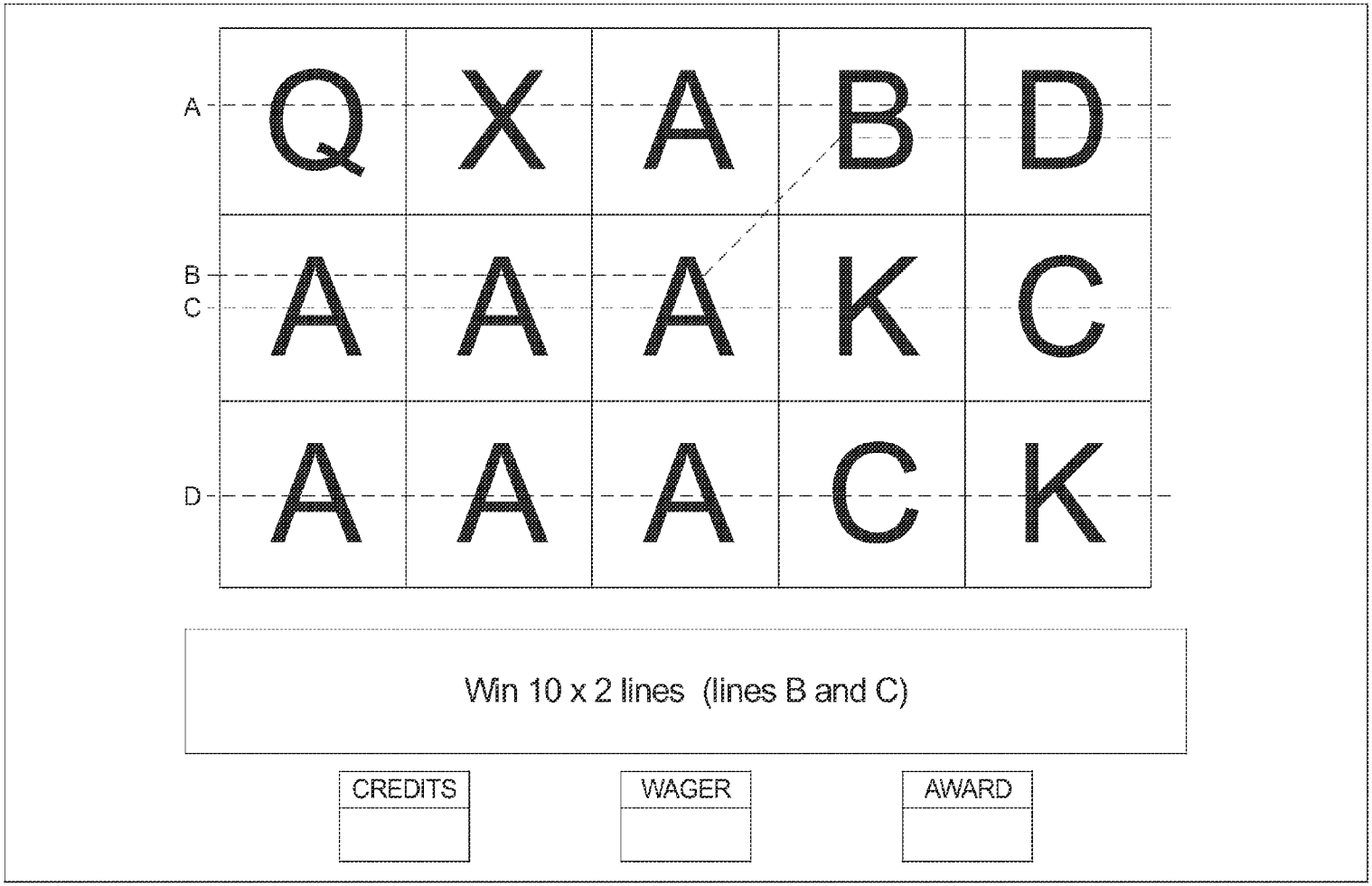
FIG. 1B PRIOR ART
FIGS. 1B and 1C illustrate screen shots of a prior art gaming system configured to simultaneously display awards associated with paylines that overlap a same displayed instance of a winning symbol combination and to separately display awards associated with paylines that overlap a different displayed instance of that winning symbol combination.
Figure 1C:
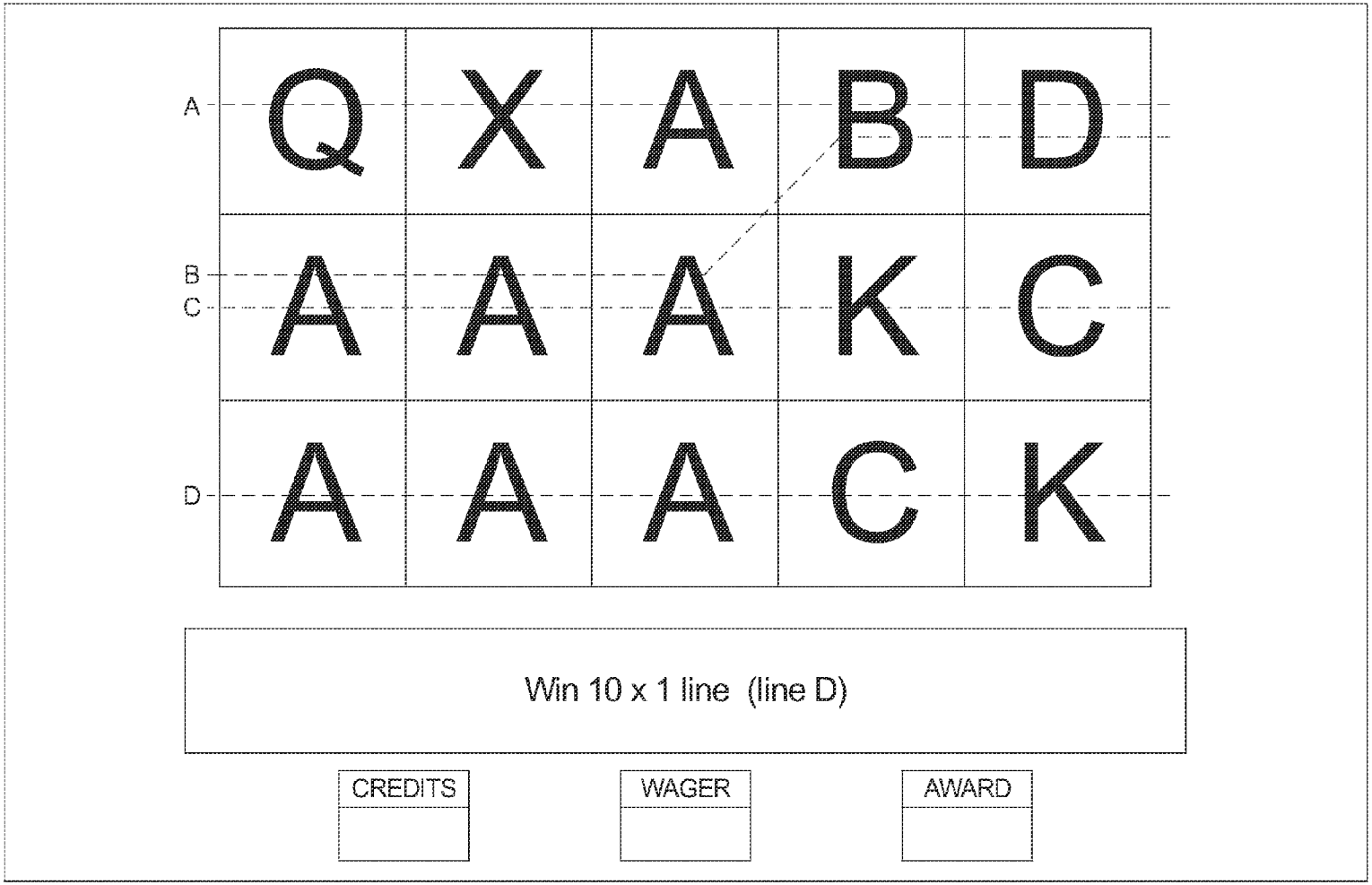
FIG. 1C PRIOR ART
Figure 2:
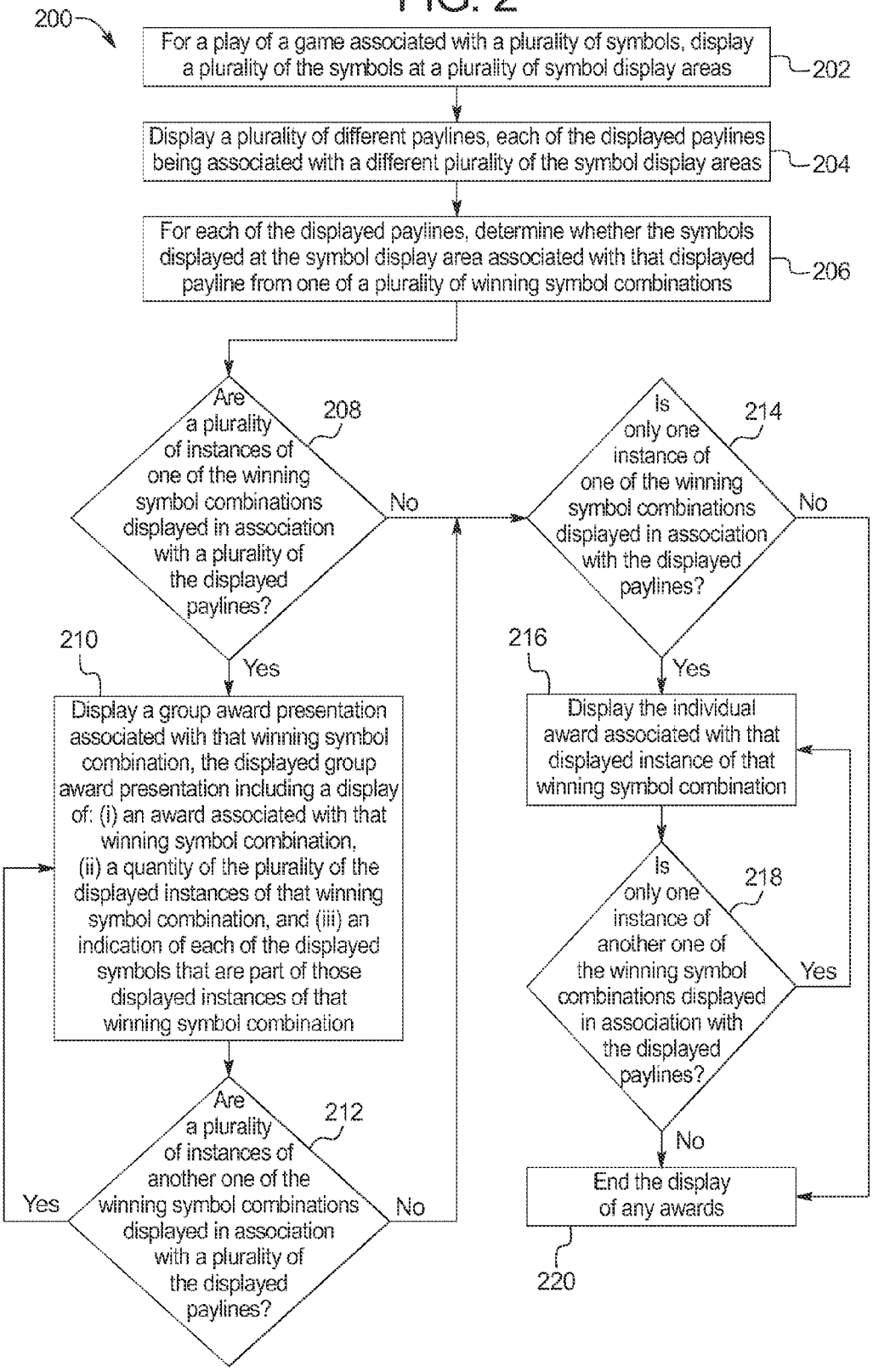
FIG. 2 is a flowchart illustrating an example method of operating an embodiment of the gaming system of the present disclosure employing a group award presentation including a simultaneous display of the awards associated with a plurality of simultaneously displayed instances of a winning symbol combination.

FIG. 2 illustrates a flowchart of a process or method 200 for operating an example of one such embodiment of the gaming system of the present disclosure. In various embodiments, process 200 is represented by a set of instructions stored in one or more memories and executed by one or more processors. Although process 100 is described with reference to the flowchart shown in FIG. 2, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In this example, for a play of a game associated with a plurality of symbols, the gaming system displays a plurality of the symbols at a plurality of symbol display areas, as indicated by block 202. The gaming system also displays a plurality of different paylines, as indicated by block 204. Each of the displayed paylines is associated with a different plurality of the symbol display areas. For each of the displayed paylines, the gaming system determines whether the symbols displayed at the symbol display areas associated with that displayed payline form one of a plurality of winning symbol combinations, as indicated by block 206. Each of the winning symbol combinations is associated with one of a plurality of different awards. The gaming system determines whether a plurality of instances of one of the winning symbol combinations are simultaneously displayed in association with a plurality of the displayed paylines, as indicated by diamond 208. If not, process 200 proceeds to diamond 214, described below.

If the gaming system determines that a plurality of instances of one of the winning symbol combinations are simultaneously displayed in association with a plurality of the displayed paylines, the gaming system displays a group award presentation associated with that winning symbol combination, as indicated by block 210. In this example, the displayed group award presentation includes a display of: (a) the award associated with that winning symbol combination, (b) a quantity of the plurality of the instances of that winning symbol combination simultaneously displayed in association with the plurality of the displayed paylines, and (c) an indication of the displayed symbols of those simultaneously displayed instances of that winning symbol combination. The gaming system determines whether a plurality of instances of another one of the winning symbol combinations are simultaneously displayed in association with a plurality of the displayed paylines, as indicated by diamond 212. If the gaming system determines that a plurality of instances of another one of the winning symbol combinations are simultaneously displayed in association with a plurality of the displayed paylines, process 200 returns to block 210, described above.

If not, the gaming system determines whether only one instance of one of the winning symbol combinations is displayed in association with the displayed paylines, as indicated by diamond 214. If not, process 200 proceeds to block 220, described below. If the gaming system determines that only one instance of one of the winning symbol combinations is displayed in association with the displayed paylines, the gaming system displays the individual award associated with that single displayed instance of that winning symbol combination, as indicated by block 216. The gaming system determines whether only one instance of another one of the winning symbol combinations is displayed in association with the displayed paylines, as indicated by diamond 218. If the gaming system determines that only one instance of another one of the winning symbol combinations is displayed in association with the displayed paylines, process 200 returns to block 218, described above. If not, the gaming system ends the display of any awards, as indicated by block 220.

Figure 3A:
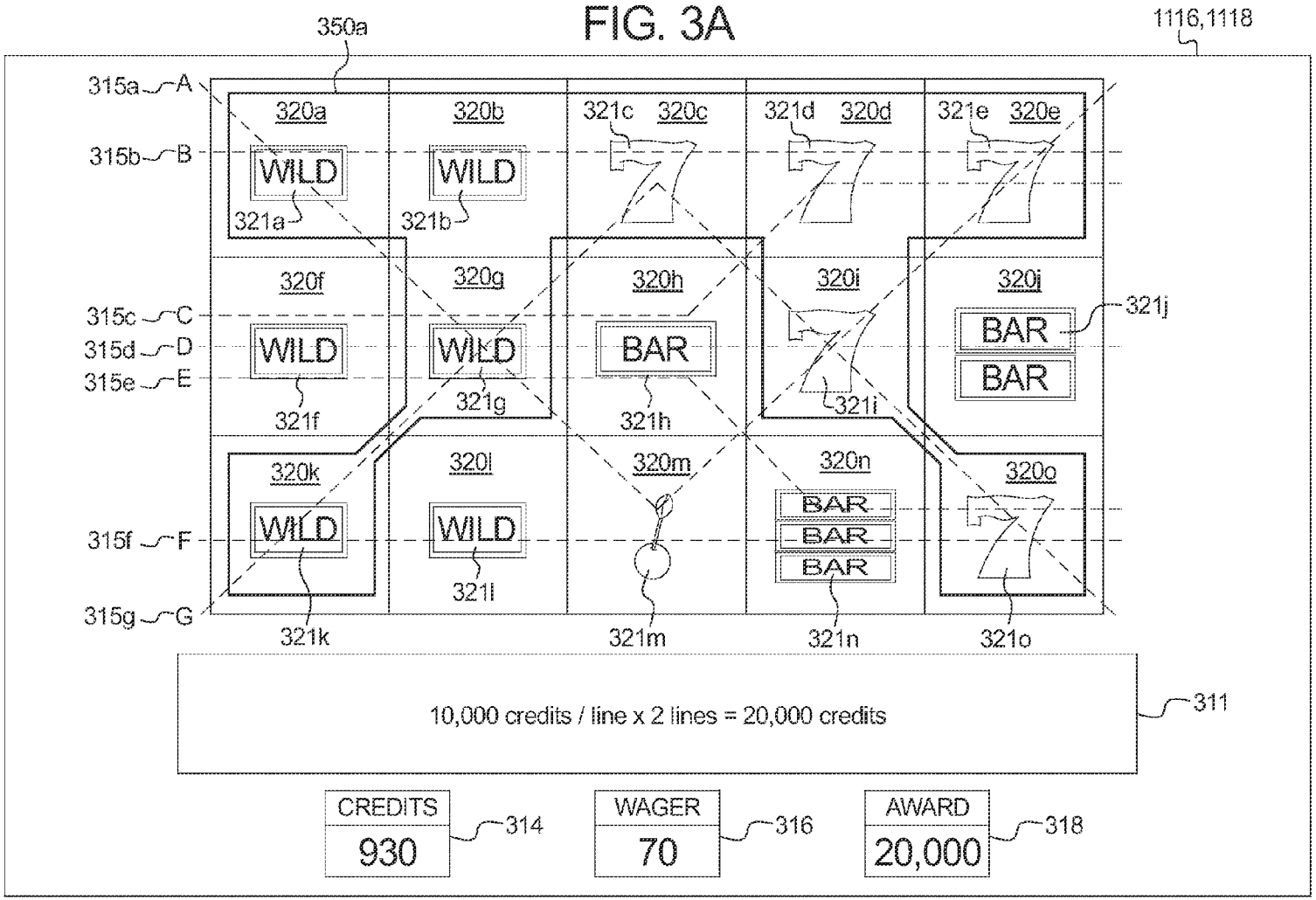
FIGS. 3A, 3B, and 3C illustrate screen shots of an example of an embodiment of the gaming system of the present disclosure employing a group award presentation including a simultaneous display of the awards associated with a plurality of simultaneously displayed instances of a winning symbol combination.
Figure 3B:
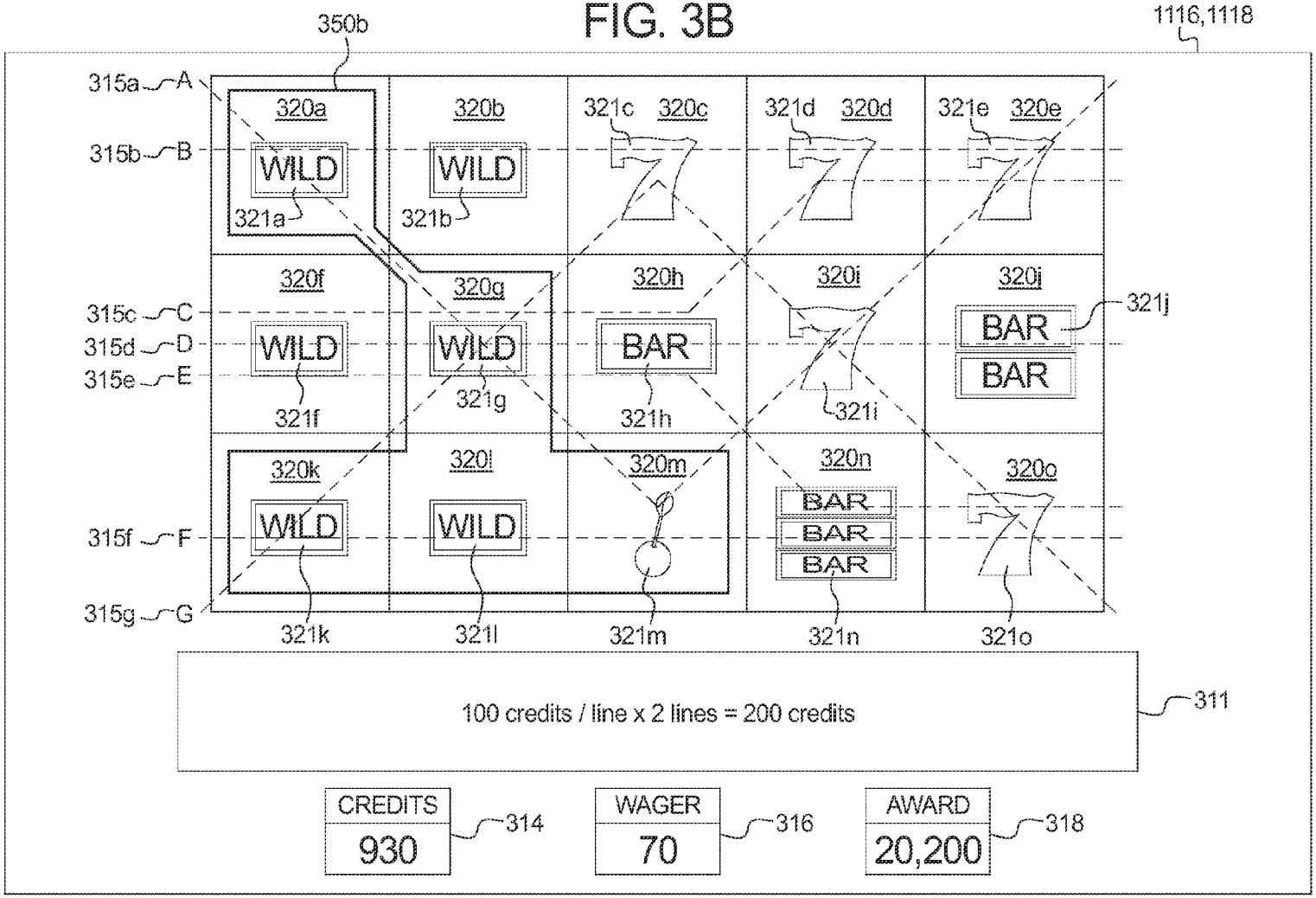
Figure 3C:
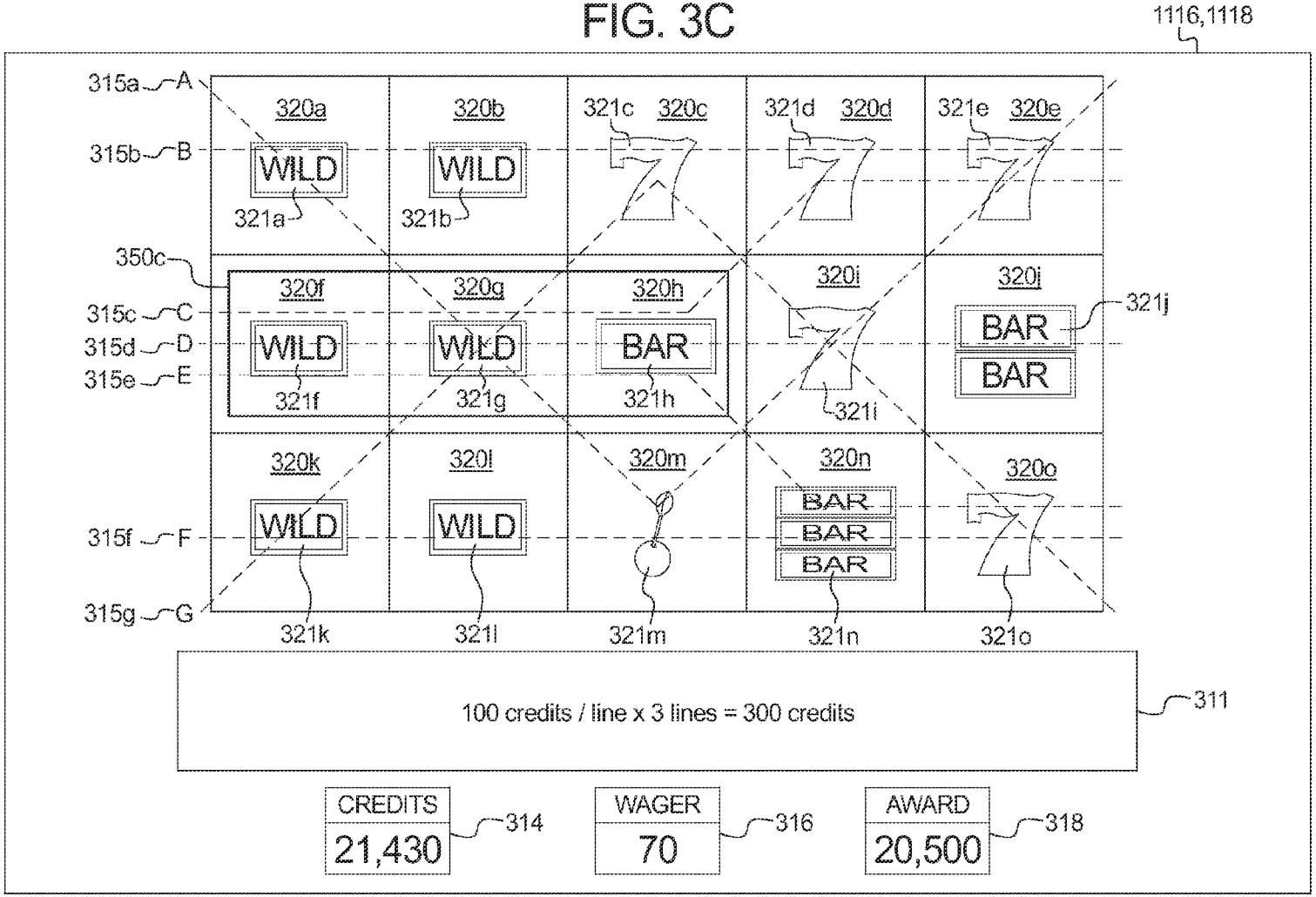

FIGS. 3A, 3B, and 3C illustrate screen shots of an example of another such embodiment of the gaming system of the present disclosure configured to display a group award presentation associated with a winning symbol combination when a plurality of instances of that winning symbol combination are simultaneously displayed in association with a plurality of paylines for a play of a game. In this example, the gaming system is configured to operate a primary wagering game associated with a plurality of symbols. The primary wagering game is a slot-type game in this example, though it should be appreciated that any suitable game may be employed.

The gaming system displays (such as on a display device 1116 or 1118, described below) a plurality of symbol display areas 320*a*, 320*b*, 320*c*, 320*d*, 320*e*, 320*f*, 320*g*, 320*h*, 320*i*, 320*j*, 320*k*, 320*l*, 320*m*, 320*n*, and 320*o* arranged in a 3×5 matrix. Each of the symbol display areas is configured to display one of the symbols. The gaming system also displays a plurality of different paylines for the primary wagering game. Each of the paylines is associated with a different plurality of the symbol display areas. Specifically, in this example, payline A 315*a* is associated with symbol display areas 320*a*, 320*g*, 320*m*, 320*i*, and 320*e*; payline B 315*b* is associated with symbol display areas 320*a*, 320*b*, 320*c*, 320*d*, and 320*e*; payline C 315*c* is associated with symbol display areas 320*f*, 320*g*, 320*h*, 320*d*, and 320*e*; payline D 315*d* is associated with symbol display areas 320*f*, 320*g*, 320*h*, 320*i*, and 320*j*; payline E 315*e* is associated with symbol display areas 320*f*, 320*g*, 320*h*, 320*n*, and 320*o*; payline F 315*f* is associated with symbol display areas 320*k*, 320*g*, 320*c*, 320*i*, and 320*o*; and payline G 315*g* is associated with symbol display areas 320*k*, 320*l*, 320*m*, 320*n*, and 320*o*. Payline A 315*a*, payline B 315*b*, payline C 315*c*, payline D 315*d*, payline E 315*e*, payline F 315*f*, and payline G 315*g* are sometimes referred to herein as paylines A, B, C, D, E, F, and G.

The gaming system employs a paytable (not shown) for the primary wagering game that includes a plurality of winning symbol combinations and the credit payout associated with each respective winning symbol combination. Specifically, in this example, the paytable includes the credit payout associated with each respective winning symbol combination when the maximum wager, which is 70 credits in this example (but could be any suitable amount), is placed for a play of the primary wagering game. Specifically, winning symbol combination:

(a) SEVEN-SEVEN-SEVEN-SEVEN-SEVEN is associated with an award of 10,000 credits;
(b) TRIPLE BAR-TRIPLE BAR-TRIPLE BAR-TRIPLE BAR is associated with an award of 2,000 credits;
(c) DOUBLE BAR-DOUBLE BAR-DOUBLE BAR is associated with an award of 375 credits;
(d) TRIPLE CHERRY-TRIPLE CHERRY-TRIPLE CHERRY is associated with an award of 250 credits;
(e) BAR-BAR-BAR is associated with an award of 100 credits; and
(f) CHERRY-CHERRY-CHERRY is associated with an award of 100 credits.

Additionally, in this example, the gaming system displays: a message display area 311, which displays information, notifications, and/or messages before, during, or after play of the primary wagering game; a credit meter 314, which displays a player's credit balance in the form of an amount of credits in this example; a wager indicator 316, which displays the player's wager for a play of the primary wagering game in the form of an amount of credits in this example; and an award meter 318, which displays any awards provided to the player in the form of an amount of credits in this example. While in this illustrated example the gaming system indicates the player's credit balance, the player's wager, and any awards provided to the player in the form of amounts of credits, it should be appreciated that such indications may alternatively or additionally be made in the form of amounts of currency.

As illustrated in FIG. 3A, upon initiation of a play of the primary wagering game for the maximum wager of 70 credits (as shown by wager indicator 316), the gaming system determined and displayed an outcome for the play of the primary wagering game by generating and displaying a plurality of the symbols at the symbol display areas. Specifically, the gaming system generated and displayed: WILD symbol 321*a* at symbol display area 320*a*, WILD symbol 321*b* at symbol display area 320*b*, SEVEN symbol 321*c* at symbol display area 320*c*, SEVEN symbol 321*d* at symbol display area 320*d*, SEVEN symbol 321*e* at symbol display area 320*e*, WILD symbol 321*f* at symbol display area 320*f*, WILD symbol 321*g* at symbol display area 320*g*, BAR symbol 321*h* at symbol display area 320*h*, TRIPLE CHERRY symbol 321*i* at symbol display area 320*i*, DOUBLE BAR symbol 321*j* at symbol display area 320*j*, WILD symbol 321*k* at symbol display area 320*k*, WILD symbol 321*l* at symbol display area 320*l*, CHERRY symbol 321*m* at symbol display area 320*m*, TRIPLE BAR symbol 321*n* at symbol display area 320*n*, and CHERRY symbol 321*o* at symbol display area 320*o*.

In this example, the gaming system determines, for each of the winning symbol combinations, whether a plurality of instances of that winning symbol combination are simultaneously displayed in association with a plurality of the displayed paylines. If the gaming system determines that a plurality of instances of that winning symbol combination are simultaneously displayed in association with a plurality of the displayed paylines, the gaming system displays a group award presentation associated with that winning symbol combination. If not, the gaming system determines whether only one instance of that winning symbol combination is displayed in association with the displayed paylines. If the gaming system determines that only one instance of that winning symbol combination is displayed in association with the displayed paylines, the gaming system displays the individual award associated with that displayed instance of that winning symbol combination. If not, the gaming system does not display any awards associated with that winning symbol combination.

In other words, in this example, for each of the winning symbol combinations, the gaming system determines whether: (a) more than one, (b) one, or (c) zero instances of that winning symbol combination are displayed in association with the displayed paylines. If more than one instance of that winning symbol combination are simultaneously displayed in association with the displayed paylines, the gaming system displays a group award presentation associated with that winning symbol combination. If only one instance of that winning symbol combination is displayed in association with the displayed paylines, the gaming system displays the individual award associated with that single displayed instance of that winning symbol combination. If no instance of that winning symbol combination is displayed in association with the displayed paylines, the gaming system does not display any awards associated with that winning symbol combination.

In this example, the group award presentation associated with a given winning symbol combination includes a display of: (a) the award associated with that winning symbol combination, (b) a quantity of the plurality of instances of that winning symbol combination simultaneously displayed in association with the displayed paylines, and (c) an indication of the displayed symbols of those simultaneously displayed instances of that winning symbol combination. In this example, the indication is a border collectively surrounding each of the displayed symbols of the displayed instances of the winning symbol combination.

Returning to FIG. 3A, the gaming system determined that two (i.e., a plurality of) instances of the SEVEN-SEVEN-SEVEN-SEVEN-SEVEN winning symbol combination were simultaneously displayed in association with a plurality of paylines A, B, C, D, E, F, and G. Specifically, the gaming system determined that winning symbol combination WILD-WILD-SEVEN-SEVEN-SEVEN (which acts as the SEVEN-SEVEN-SEVEN-SEVEN-SEVEN winning symbol combination by virtue of the WILD symbols) was displayed in association with payline B and that winning symbol combination WILD-WILD-SEVEN-SEVEN-SEVEN (which acts as the SEVEN-SEVEN-SEVEN-SEVEN-SEVEN winning symbol combination by virtue of the WILD symbols) was displayed in association with payline G.

Accordingly, the gaming system displayed a group award presentation associated with the SEVEN-SEVEN-SEVEN-SEVEN-SEVEN winning symbol combination. Specifically, the gaming system displayed the message "10,000 credits/line×2 lines=20,000 credits" at message display area 311 and displayed a border 350*a* collectively surrounding each of the displayed symbols of those two SEVEN-SEVEN-SEVEN-SEVEN-SEVEN winning symbol combinations displayed in association with paylines B and G. That is, the group award presentation included a display of: (a) the award of 10,0000 credits associated with the SEVEN-SEVEN-SEVEN-SEVEN-SEVEN winning symbol combination; (b) the quantity (i.e., two) of instances of the SEVEN-SEVEN-SEVEN-SEVEN-SEVEN winning symbol combination simultaneously displayed in association with paylines A, B, C, D, E, F, and G; and (c) an indication of the displayed symbols of those two simultaneously displayed instances of the SEVEN-SEVEN-SEVEN-SEVEN-SEVEN winning symbol combination. The gaming system displayed the 20,000 credit award associated with the displayed SEVEN-SEVEN-SEVEN-SEVEN-SEVEN winning symbol combinations in award meter 318.

Turning to FIG. 3B, the gaming system determined that two (i.e., a plurality of) instances of the CHERRY-CHERRY-CHERRY winning symbol combination were simultaneously displayed in association with a plurality of paylines A, B, C, D, E, F, and G. Specifically, the gaming system determined that winning symbol combination WILD-WILD-CHERRY (which acts as the CHERRY-CHERRY-CHERRY winning symbol combination by virtue of the WILD symbols) was displayed in association with payline A and that winning symbol combination WILD-WILD-CHERRY (which acts as the CHERRY-CHERRY-CHERRY winning symbol combination by virtue of the WILD symbols) was displayed in association with payline F.

Accordingly, the gaming system displayed a group award presentation associated with the CHERRY-CHERRY-CHERRY winning symbol combination. Specifically, the gaming system displayed the message "100 credits/line×2 lines=200 credits" at message display area 311 and displayed a border 350*b* collectively surrounding each of the displayed symbols of those two CHERRY-CHERRY-CHERRY winning symbol combinations displayed in association with paylines A and F. That is, the group award presentation included a display of: (a) the award of 100 credits associated with the CHERRY-CHERRY-CHERRY winning symbol combination; (b) the quantity (i.e., two) of instances of the CHERRY-CHERRY-CHERRY winning symbol combination simultaneously displayed in association with paylines A, B, C, D, E, F, and G; and (c) an indication of the displayed symbols of those two simultaneously displayed instances of the CHERRY-CHERRY-CHERRY winning symbol combination. The gaming system updated the award displayed in award meter 318 to reflect the 200 credit award associated with the displayed CHERRY-CHERRY-CHERRY winning symbol combinations.

Turning to FIG. 3C, the gaming system determined that three (i.e., a plurality of) instances of the BAR-BAR-BAR winning symbol combination were simultaneously displayed in association with a plurality of paylines A, B, C, D, E, F, and G. Specifically, the gaming system determined that winning symbol combination WILD-WILD-BAR (which acts as the BAR-BAR-BAR winning symbol combination by virtue of the WILD symbols) was displayed in association with payline C, that winning symbol combination WILD-WILD-BAR (which acts as the BAR-BAR-BAR winning symbol combination by virtue of the WILD symbols) was displayed in association with payline D, and that winning symbol combination WILD-WILD-BAR (which acts as the BAR-BAR-BAR winning symbol combination by virtue of the WILD symbols) was displayed in association with payline E.

Accordingly, the gaming system displayed a group award presentation associated with the BAR-BAR-BAR winning symbol combination. Specifically, the gaming system displayed the message "100 credits/line×3 lines=300 credits" at message display area 311 and displayed a border 350*c* collectively surrounding each of the displayed symbols of those three BAR-BAR-BAR winning symbol combinations displayed in association with paylines C, D, and E. That is, the group award presentation included a display of: (a) the award of 100 credits associated with the BAR-BAR-BAR winning symbol combination; (b) the quantity (i.e., three) of instances of the BAR-BAR-BAR winning symbol combination simultaneously displayed in association with paylines A, B, C, D, E, F, and G; and (c) an indication of the simultaneously displayed symbols of those three displayed instances of the BAR-BAR-BAR winning symbol combination. The gaming system updated the award displayed in award meter 318 to reflect the 300 credit award associated with the displayed BAR-BAR-BAR winning symbol combinations.

The gaming system determined that no other winning symbol combinations were displayed in association with paylines A, B, C, D, E, F, and/or G. Accordingly, the gaming system provided the 20,500 credit award for the play of the primary wagering game to the player and updated the credits displayed in credit meter 314 to from 930 credits to 21,430 credits to reflect the award. In this example, for the play of the primary wagering game, a total of seven winning symbol combinations were simultaneously displayed in association with the displayed paylines and, therefore, a total of seven individual awards (i.e., one award associated with each of the simultaneously displayed winning symbol combinations) were won. The use of the group award presentation to display certain of those seven awards as a group resulted in a total of three group award presentations being displayed rather than a total of seven individual award presentations (i.e., an individual award presentation for each award for each of the seven simultaneously displayed winning symbol combinations). Thus, in this example, the group award presentation enabled the gaming system to display the seven awards associated with the play of the primary wagering game in less than one-half of the time that it would have taken to display such awards individually. This reduced down time and lulls during award display, thus enabling faster game play and keeping the player engaged in the primary wagering game.

Further embodiments of the present disclosure contemplate, for a play of the game, a gaming system employing a group award presentation to simultaneously display the awards associated with each of a plurality of instances of a plurality of winning symbol combinations simultaneously displayed in association with a plurality of paylines, wherein those winning symbol combinations are each associated with a same award. That is, in such embodiments, the gaming system employs the group award presentation to simultaneously display such awards as a group rather than separately displaying each individual award.

Figure 4:
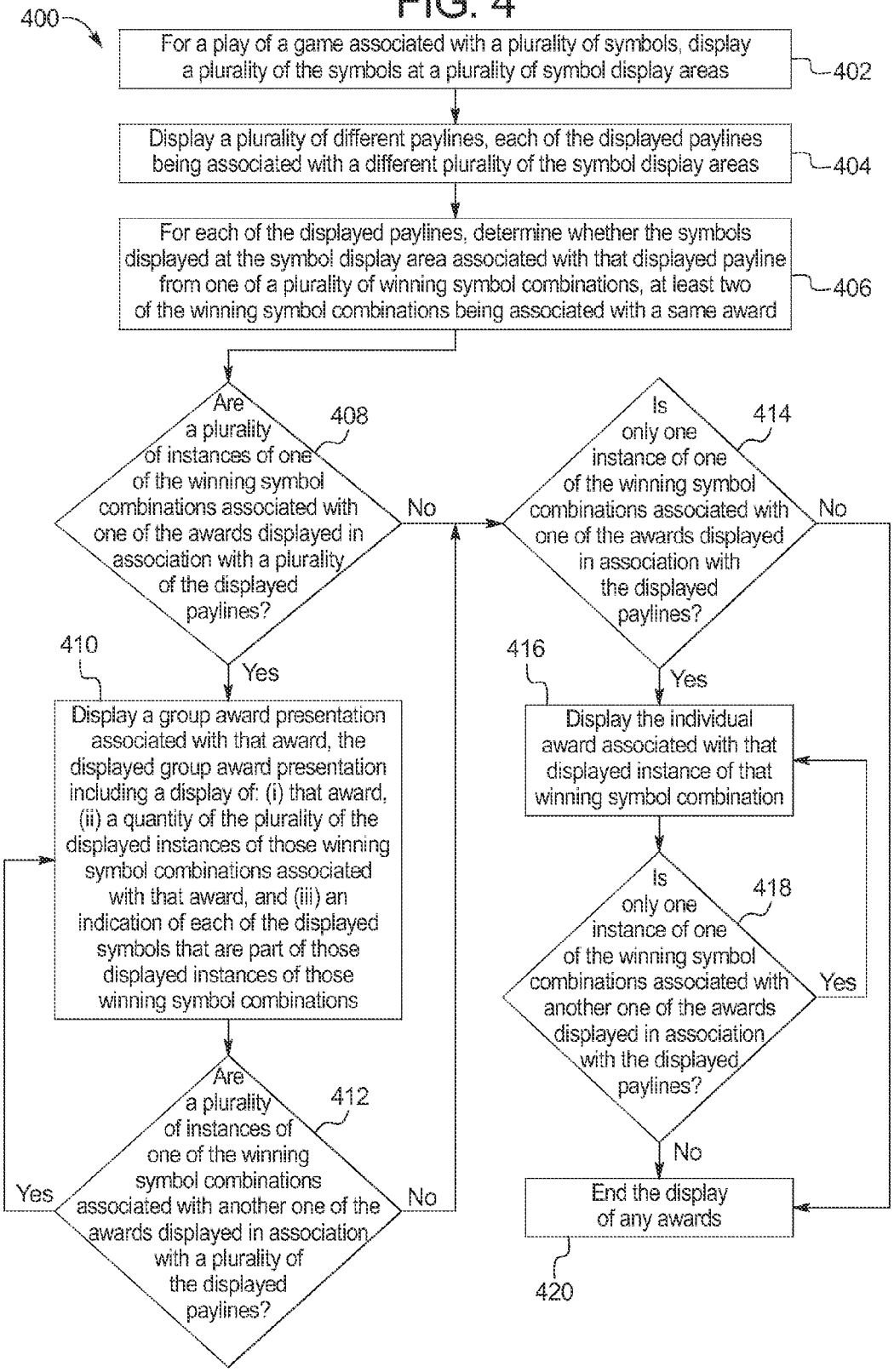
FIG. 4 is a flowchart illustrating an example method of operating an embodiment of the gaming system of the present disclosure employing a group award presentation including a simultaneous display of the awards associated with a plurality of simultaneously displayed instances of a plurality of winning symbol combinations, wherein those winning symbol combinations are associated with a same award.

FIG. 4 illustrates a flowchart of a process or method 400 for operating an example of one such embodiment of the gaming system of the present disclosure. In various embodiments, process 400 is represented by a set of instructions stored in one or more memories and executed by one or more processors. Although process 400 is described with reference to the flowchart shown in FIG. 4, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In this example, for a play of a game associated with a plurality of symbols, the gaming system displays a plurality of the symbols at a plurality of symbol display areas, as indicated by block 402. The gaming system also displays a plurality of different paylines, as indicated by block 404. Each of the displayed paylines is associated with a different plurality of the symbol display areas. For each of the displayed paylines, the gaming system determines whether the symbols displayed at the symbol display areas associated with that displayed payline form one of a plurality of winning symbol combinations, as indicated by block 406. Each of the winning symbol combinations is associated with one of a plurality of different awards, and at least two of the winning symbol combinations are associated with a same one of the awards. The gaming system determines whether a plurality of instances of the winning symbol combinations associated with one of the awards are simultaneously displayed in association with a plurality of the displayed paylines, as indicated by diamond 408. If not, process 400 proceeds to diamond 414, described below.

If the gaming system determines that a plurality of instances of the winning symbol combinations associated with that award are simultaneously displayed in association with a plurality of the displayed paylines, the gaming system displays a group award presentation associated with that award, as indicated by block 410. In this example, the displayed group award presentation includes a display of: (a) that award, (b) a quantity of the plurality of the instances of those winning symbol combinations associated with that award simultaneously displayed in association with the plurality of the displayed paylines, and (c) an indication of the displayed symbols of those simultaneously displayed instances of those winning symbol combinations. The gaming system determines whether a plurality of instances of the winning symbol combinations associated with another one of the awards are displayed in association with a plurality of the displayed paylines, as indicated by diamond 412. If the gaming system determines that a plurality of instances of the winning symbol combinations associated with another one of the awards are displayed in association with a plurality of the displayed paylines, process 400 returns to block 410, described above.

If not, the gaming system determines whether only one instance of one of the winning symbol combinations associated with one of the awards is displayed in association with the displayed paylines, as indicated by diamond 414. If not, process 400 proceeds to block 420, described below. If the gaming system determines that only one instance of one of the winning symbol combinations associated with one of the awards is displayed in association with the displayed paylines, the gaming system displays the individual award associated with that single displayed instance of that winning symbol combination, as indicated by block 416. The gaming system determines whether only one instance of one of the winning symbol combinations associated with another one of the awards is displayed in association with the displayed paylines, as indicated by diamond 418. If the gaming system determines that only one instance of one of the winning symbol combinations associated with another one of the awards is displayed in association with the displayed paylines, process 400 returns to block 418, described above. If not, the gaming system ends the display of any awards, as indicated by block 420.

Figure 5A:
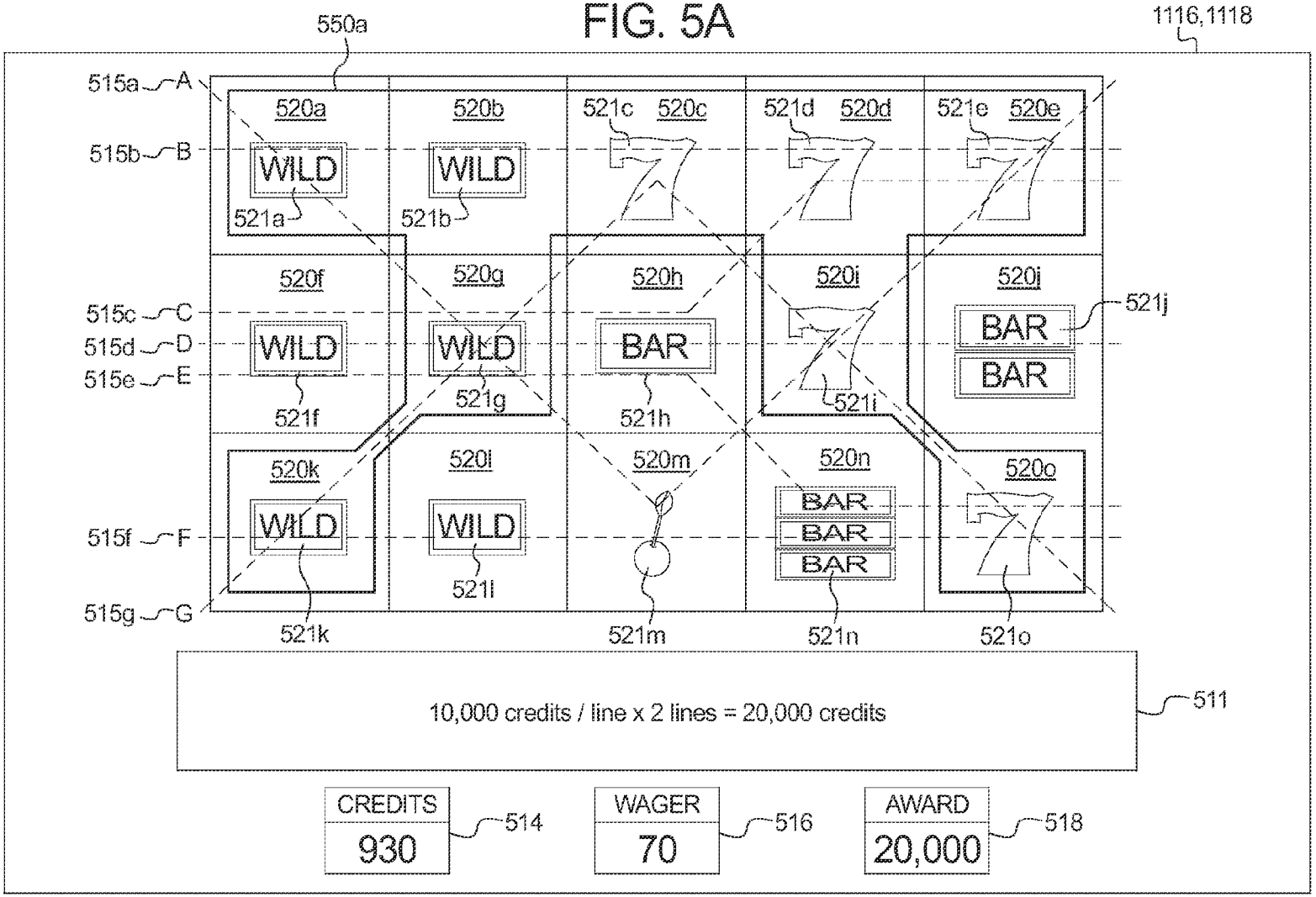
FIGS. 5A and 5B illustrate screen shots of an example of an embodiment of the gaming system of the present disclosure employing a group award presentation including a simultaneous display of the awards associated with a plurality of simultaneously displayed instances of a plurality of winning symbol combinations, wherein those winning symbol combinations are associated with a same award.
Figure 5B:
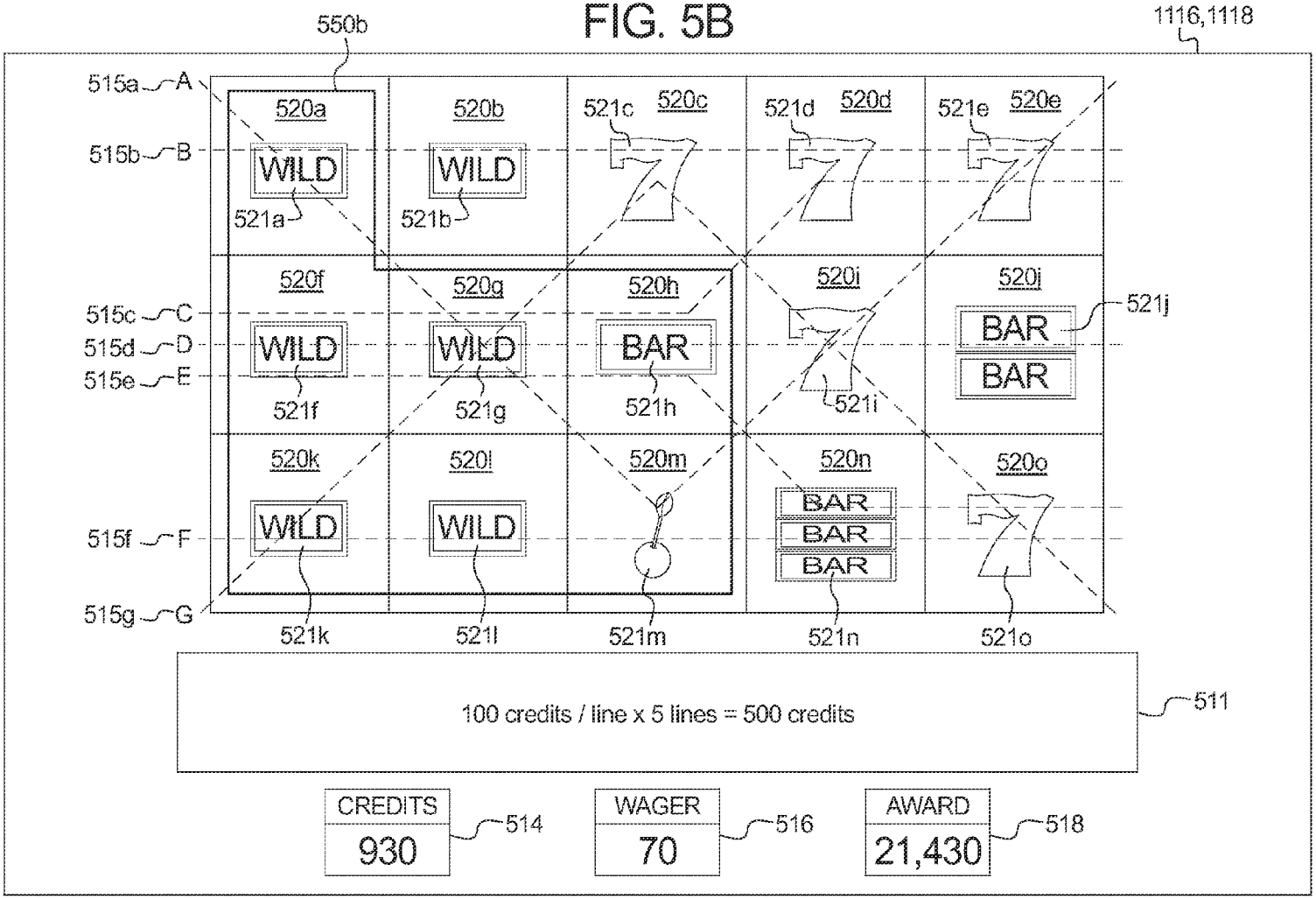

FIGS. 5A and 5B illustrate screen shots of an example of another such embodiment of the gaming system of the present disclosure configured to display a group award presentation associated with an award when a plurality of instances of the winning symbol combinations associated with that award are displayed in association with a plurality of paylines for a play of a game. In this example, the gaming system is configured to operate a primary wagering game associated with a plurality of symbols. The primary wagering game is a slot-type game in this example, though it should be appreciated that any suitable game may be employed.

The gaming system displays (such as on a display device 1116 or 1118, described below) a plurality of symbol display areas 520*a*, 520*b*, 520*c*, 520*d*, 520*e*, 520*f*, 520*g*, 520*h*, 520*i*, 520*j*, 520*k*, 520*l*, 520*m*, 520*n*, and 520*o* arranged in a 3×5 matrix. Each of the symbol display areas is configured to display one of the symbols. The gaming system also displays a plurality of different paylines for the primary wagering game. Each of the paylines is associated with a different plurality of the symbol display areas. Specifically, in this example, payline A 515*a* is associated with symbol display areas 520*a*, 520*g*, 520*m*, 520*i*, and 520*e*; payline B 515*b* is associated with symbol display areas 520*a*, 520*b*, 520*c*, 520*d*, and 520*e*; payline C 515*c* is associated with symbol display areas 520*f*, 520*g*, 520*h*, 520*d*, and 520*e*; payline D 515*d* is associated with symbol display areas 520*f*, 520*g*, 520*h*, 520*i*, and 520*j*; payline E 515*e* is associated with symbol display areas 520*f*, 520*g*, 520*h*, 520*n*, and 520*o*; payline F 515*f* is associated with symbol display areas 520*k*, 520*g*, 520*c*, 520*i*, and 520*o*; and payline G 515*g* is associated with symbol display areas 520*k*, 520*l*, 520*m*, 520*n*, and 520*o*. Payline A 515*a*, payline B 515*b*, payline C 515*c*, payline D 515*d*, payline E 515*e*, payline F 515*f*, and payline C 515*g* are sometimes referred to herein as paylines A, B, C, D, E, F, and G.

The gaming system employs a paytable (not shown) for the primary wagering game that includes a plurality of winning symbol combinations and the credit payout (i.e., the award) associated with each respective winning symbol combination. Specifically, in this example, the paytable includes the credit payout associated with each respective winning symbol combination when the maximum wager, which is 70 credits in this example (but could be any suitable amount), is placed for a play of the primary wagering game. Specifically, winning symbol combination:

(a) SEVEN-SEVEN-SEVEN-SEVEN-SEVEN is associated with an award of 10,000 credits;

(b) TRIPLE BAR-TRIPLE BAR-TRIPLE BAR-TRIPLE BAR is associated with an award of 2,000 credits;

(c) DOUBLE BAR-DOUBLE BAR-DOUBLE BAR is associated with an award of 375 credits;

(d) TRIPLE CHERRY-TRIPLE CHERRY-TRIPLE CHERRY is associated with an award of 250 credits;

(e) BAR-BAR-BAR is associated with an award of 100 credits; and (f) CHERRY-CHERRY-CHERRY is associated with an award of 100 credits.

In this example, both the BAR-BAR-BAR and the CHERRY-CHERRY-CHERRY winning symbol combinations (i.e., a plurality of the winning symbol combinations) are associated with a same one of the awards—the award of 100 credits.

Additionally, in this example, the gaming system displays: a message display area 511, which displays information, notifications, and/or messages before, during, or after play of the primary wagering game; a credit meter 514, which displays a player's credit balance in the form of an amount of credits in this example; a wager indicator 516, which displays the player's wager for a play of the primary wagering game in the form of an amount of credits in this example; and an award meter 518, which displays any awards provided to the player in the form of an amount of credits in this example. While in this illustrated example the gaming system indicates the player's credit balance, the player's wager, and any awards provided to the player in the form of amounts of credits, it should be appreciated that such indications may alternatively or additionally be made in the form of amounts of currency.

As illustrated in FIG. 5A, upon initiation of a play of the primary wagering game for the maximum wager of 70 credits (as shown by wager indicator 516), the gaming system determined and displayed an outcome for the play of the primary wagering game by generating and displaying a plurality of the symbols at the symbol display areas. Specifically, the gaming system generated and displayed: WILD symbol 521*a* at symbol display area 520*a*, WILD symbol 521*b* at symbol display area 520*b*, SEVEN symbol 521*c* at symbol display area 520*c*, SEVEN symbol 521*d* at symbol display area 520*d*, SEVEN symbol 521*e* at symbol display area 520*e*, WILD symbol 521*f* at symbol display area 520*f*, WILD symbol 521*g* at symbol display area 520*g*, BAR symbol 521*h* at symbol display area 520*h*, TRIPLE CHERRY symbol 521*i* at symbol display area 520*i*, DOUBLE BAR symbol 521*j* at symbol display area 520*j*, WILD symbol 521*k* at symbol display area 520*k*, WILD symbol 521*l* at symbol display area 520*l*, CHERRY symbol 521*m* at symbol display area 520*m*, TRIPLE BAR symbol 521*n* at symbol display area 520*n*, and CHERRY symbol 521*o* at symbol display area 520*o*.

In this example, the gaming system determines, for each of the awards, whether a plurality of instances of the winning symbol combination or combinations associated with that award are simultaneously displayed in association with a plurality of the displayed paylines. If the gaming system determines that a plurality of instances of those winning symbol combinations associated with that award are simultaneously displayed in association with a plurality of the displayed paylines, the gaming system displays a group award presentation associated with that award. If not, the gaming system determines whether only one instance of one of the winning symbol combinations associated with that award is displayed in association with the displayed paylines. If the gaming system determines that only one instance of one of the winning symbol combinations associated with that award is displayed in association with the displayed paylines, the gaming system displays the individual award associated with that displayed instance of that winning symbol combination. If not, the gaming system does not display any awards associated with those winning symbol combinations associated with that award.

In other words, in this example, for each of the awards, the gaming system determines whether: (a) more than one, (b) one, or (c) zero instances of the winning symbol combinations associated with that award are displayed in association with the displayed paylines. If more than one instance of those winning symbol combinations are simultaneously displayed in association with the displayed paylines, the gaming system displays a group award presentation associated with that award. If only one instance of those winning symbol combinations is displayed in association with the displayed paylines, the gaming system displays the individual award associated with that single displayed instance of that winning symbol combination. If no instance of those winning symbol combinations is displayed in association with the displayed paylines, the gaming system does not display any awards associated with that winning symbol combination.

In this example, the group award presentation associated with a given award includes a display of: (a) that award, (b) a quantity of the plurality of instances of the winning symbol combinations associated with that award simultaneously displayed in association with the displayed paylines, and (c) an indication of the displayed symbols of those simultaneously displayed instances of those winning symbol combinations. In this example, the indication is a border collectively surrounding each of the displayed symbols of the displayed instances of the winning symbol combinations.

Returning to FIG. 5A, the 10,000 credit award is associated with the SEVEN-SEVEN-SEVEN-SEVEN-SEVEN winning symbol combination. In this example, the gaming system determined that two (i.e., a plurality of) instances of the SEVEN-SEVEN-SEVEN-SEVEN-SEVEN winning symbol combination associated with the 10,000 credit award were simultaneously displayed in association with a plurality of paylines A, B, C, D, E, F, and G. Specifically, the gaming system determined that winning symbol combination WILD-WILD-SEVEN-SEVEN-SEVEN (which acts as the SEVEN-SEVEN-SEVEN-SEVEN-SEVEN winning symbol combination by virtue of the WILD symbols) was displayed in association with payline B and that winning symbol combination WILD-WILD-SEVEN-SEVEN-SEVEN (which acts as the SEVEN-SEVEN-SEVEN-SEVEN-SEVEN winning symbol combination by virtue of the WILD symbols) was displayed in association with payline G.

Accordingly, the gaming system displayed a group award presentation associated with the 10,000 credit award. Specifically, the gaming system displayed the message "10,000 credits/line×2 lines=20,000 credits" at message display area 511 and displayed a border 550*a* collectively surrounding each of the displayed symbols of those two SEVEN-SEVEN-SEVEN-SEVEN-SEVEN winning symbol combinations displayed in association with paylines B and G. That is, the group award presentation included a display of: (a) the award of 10,0000 credits; (b) the quantity (i.e., two) of instances of the SEVEN-SEVEN-SEVEN-SEVEN-SEVEN winning symbol combination simultaneously displayed in association with paylines A, B, C, D, E, F, and C; and (c) an indication of the displayed symbols of those two simultaneously displayed instances of the SEVEN-SEVEN-SEVEN-SEVEN-SEVEN winning symbol combination. The gaming system displayed the 20,000 credit award associated with the displayed SEVEN-SEVEN-SEVEN-SEVEN-SEVEN winning symbol combinations in award meter 318.

Turning to FIG. 5B, the 100 credit award is associated with both the BAR-BAR-BAR and the CHERRY-CHERRY-CHERRY winning symbol combinations. In this example, the gaming system determined that two (i.e., a plurality of) instances of the CHERRY-CHERRY-CHERRY winning symbol combination and three (i.e., a plurality of) instances of the BAR-BAR-BAR winning symbol combination associated with the 100 credit award were simultaneously displayed in association with a plurality of paylines A, B, C, D, E, F, and G. Specifically, the gaming system determined that winning symbol combination WILD-WILD-CHERRY (which acts as the CHERRY-CHERRY-CHERRY winning symbol combination by virtue of the WILD symbols) was displayed in association with payline A, that winning symbol combination WILD-WILD-CHERRY (which acts as the CHERRY-CHERRY-CHERRY winning symbol combination by virtue of the WILD symbols) was displayed in association with payline F, that winning symbol combination WILD-WILD-BAR (which acts as the BAR-BAR-BAR winning symbol combination by virtue of the WILD symbols) was displayed in association with payline C, that winning symbol combination WILD-WILD-BAR (which acts as the BAR-BAR-BAR winning symbol combination by virtue of the WILD symbols) was displayed in association with payline D, and that winning symbol combination WILD-WILD-BAR (which acts as the BAR-BAR-BAR winning symbol combination by virtue of the WILD symbols) was displayed in association with payline E.

Accordingly, the gaming system displayed a group award presentation associated with the 100 credit award. Specifically, the gaming system displayed the message "100 credits/line×5 lines=500 credits" at message display area 511 and displayed a border 550*b* collectively surrounding each of the displayed symbols of those two CHERRY-CHERRY-CHERRY winning symbol combinations displayed in association with paylines A and F and those three BAR-BAR-BAR winning symbol combinations displayed in association with paylines C, D, and E. That is, the group award presentation included a display of: (a) the award of 100 credits; (b) the quantity (i.e., five) of instances of the CHERRY-CHERRY-CHERRY and the BAR-BAR-BAR winning symbol combinations simultaneously displayed in association with paylines A, B, C, D, E, F, and G; and (c) an indication of the displayed symbols of those five simultaneously displayed instances of the CHERRY-CHERRY-CHERRY and the BAR-BAR-BAR winning symbol combinations. The gaming system updated the award displayed in award meter 518 to reflect the 500 credit award associated with the displayed CHERRY-CHERRY-CHERRY and the displayed BAR-BAR-BAR winning symbol combinations.

The gaming system determined that no other winning symbol combinations were displayed in association with paylines A, B, C, D, E, F, and/or G. Accordingly, the gaming system provided the 20,500 credit award for the play of the primary wagering game to the player and updated the credits displayed in credit meter 514 to from 930 credits to 21,430 credits to reflect the award. In this example, for the play of the primary wagering game, a total of seven winning symbol combinations were simultaneously displayed in association with the displayed paylines and, therefore, a total of seven individual awards (i.e., one award associated with each of the displayed winning symbol combinations) were won. The use of the group award presentation to display certain of those seven awards as a group resulted in a total of two group award presentations being displayed rather than a total of seven individual award presentations (i.e., an individual award presentation for each award for each of the seven simultaneously displayed winning symbol combinations). Thus, in this example, the group award presentation enabled the gaming system to display the seven awards associated with the play of the primary wagering game in less than one-third of the time that it would have taken to display such awards individually. This reduced down time and lulls during award display, thus enabling faster game play and keeping the player engaged in the primary wagering game.

It should be appreciated that, in certain embodiments of the present disclosure including those described above, the gaming system employs the group award presentation associated with a winning symbol combination or associated with an award regardless of which symbol display areas are associated with the paylines along which the indications of the winning symbol combination(s) are displayed. In other words, in these embodiments of the present disclosure, the gaming system is not limited to displaying groups of awards for indications of winning symbol combination(s) that share one or more symbol display areas (i.e., that are displayed along paylines that share one or more coordinates). Rather, the present disclosure contemplates that the gaming system employs the group award presentation for indications of winning symbol combinations displayed along paylines that do not share any symbol display areas.

In various embodiments: (a) the primary wagering game may be associated with, and the gaming system may display, any suitable quantity of symbol display areas in any suitable configuration or arrangement; (b) the primary wagering game may be associated with, and the gaming system may display, any suitable quantity of paylines for the primary wagering game; (c) each of the displayed paylines may be associated with any suitable quantity of the symbol display areas and any suitable combination of the symbol display areas; (d) the gaming system may use any other suitable award determination other than a payline evaluation, such as a ways to win and/or a scatter pay award determination (as described below); (e) the gaming system may modify the paytable to reflect lower credit payouts when a wager that is less than the maximum wager is placed on a play of the primary wagering game; (f) the gaming system may employ suitable paytable including any suitable quantity of winning symbol combinations; (g) the gaming system may use any suitable combination of the symbols as a winning symbol combination; (h) the winning symbol combinations may be associated with any suitable credit payouts; (i) the gaming system may utilize any suitable quantity of paytables; and (j) the gaming system may employ any suitable symbols including, for example, any suitable markings or indicia such as letters, numbers, or illustrations or pictures of objects.

In one embodiment, the indicator includes separate borders that each surrounds a different indicated symbol rather than a single border surrounding all indicated symbols. In another embodiment, the indicator pulsates, sparkles, flashes, changes color, or provides another suitable effect when certain awards are provided. In one example, the indicator's pulsation becomes more pronounced as larger awards are provided. In another example, the indicator's color becomes darker as larger awards are provided. In one embodiment in which the gaming system includes a transmissive display having an inner and an outer display, the gaming system "pops out" the indicated symbols such that they are displayed on the outer display.

In certain embodiments, the gaming system limits the quantity of indications of a winning symbol combination or combinations displayed in association with a plurality of paylines that may be displayed in association with a single group award presentation. That is, in these embodiments, the gaming system limits how many awards may be displayed by a single group award presentation. In one example, the primary wagering game is a slot game associated with 200 paylines. In this example, the gaming system limits each group award presentation such that each group award presentation may simultaneously display a maximum of twenty awards associated with a given winning symbol combination or a given award. Thus, in this example, each group award presentation is associated with up to, but no more than, twenty awards. If forty indications of a winning symbol combination are displayed in association with a plurality of paylines, the gaming system displays a first group award presentation for a first twenty of those forty displayed indications and a second group award presentation for the remaining twenty of those forty displayed indications.

In other embodiments, the gaming system employs group award presentations in association with a multiway gaming system that enables players to play multiple games at once. In one example, the gaming system enables a player to simultaneously play four slot games. In such embodiments, the gaming system employs group award presentations collectively across a plurality of the simultaneously displayed games. In one example, the gaming system employs a collective group award presentation across all of the simultaneously displayed games (such as by employing a single award meter to display the group award presentation). In another example, the gaming system employs separate collective group award presentations for different groups of the simultaneously displayed games (such as by highlighting two of four simultaneously displayed games and displaying a collective group award presentation associated with those two games, and then highlighting the remaining two simultaneously displayed games and displaying a collective group award presentation associated with those two games). In certain embodiments employing such collective group award presentations, the gaming system displays an indication of all of the displayed symbols that are part of a designated winning symbol combination at once, such as by displaying a single border surrounding each such symbol.

In various embodiments, the gaming system's use of group award presentations may be disabled. In one such embodiment, a game engineer or other game manufacturer's representative determines whether to enable or disable group award presentations for a given game. In another such embodiment, the game operator or other casino representative determines whether to enable or disable group award presentations. This enables game operators to configure their gaming systems to suit their preference. In another such embodiment, the gaming system employs group award presentations depending upon the jurisdiction in which the gaming system operates. This enables a given gaming system the flexibility to operate in jurisdictions in which group award presentations are not permitted and in jurisdictions in which group award presentations are permitted. In another such embodiment, the gaming system enables the player to choose whether to enable group award presentations.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines (EGMs); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 6A:
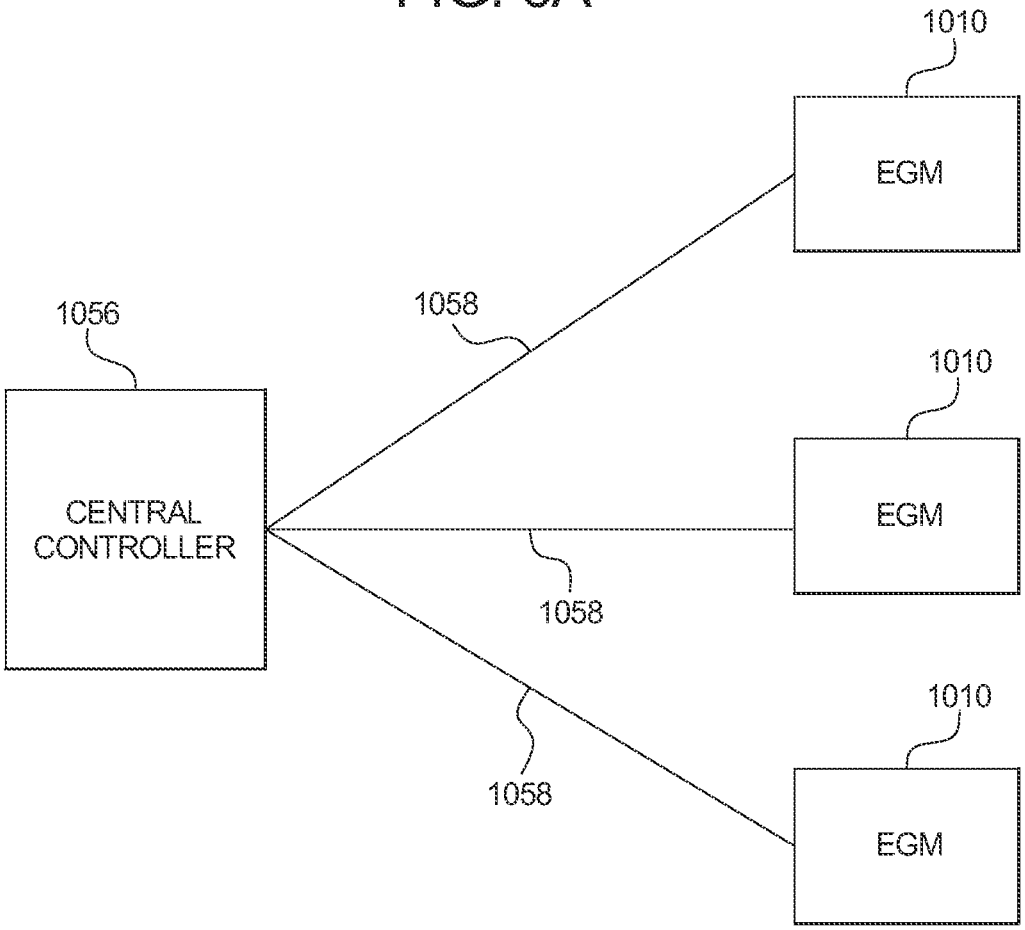
FIG. 6A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 6A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 6B:
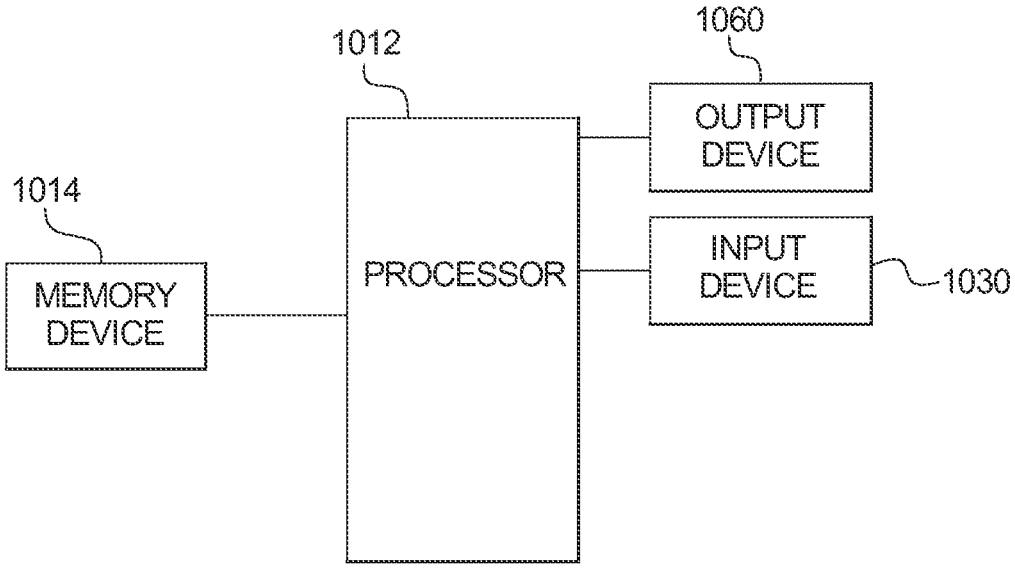
FIG. 6B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 6B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 6B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 7A:
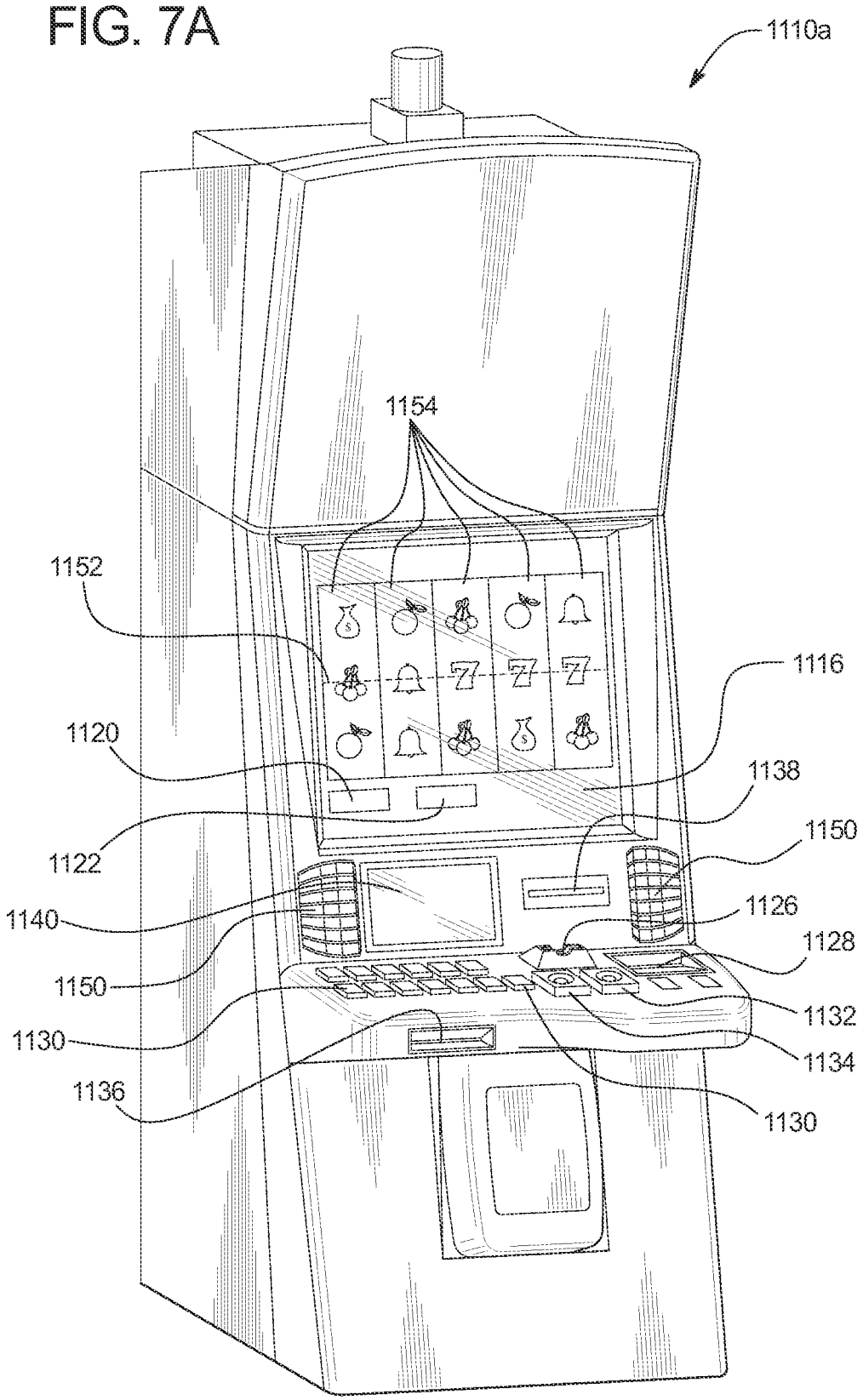
FIGS. 7A and 7B are perspective views of example alternative embodiments of the gaming system of the present disclosure.
Figure 7B:
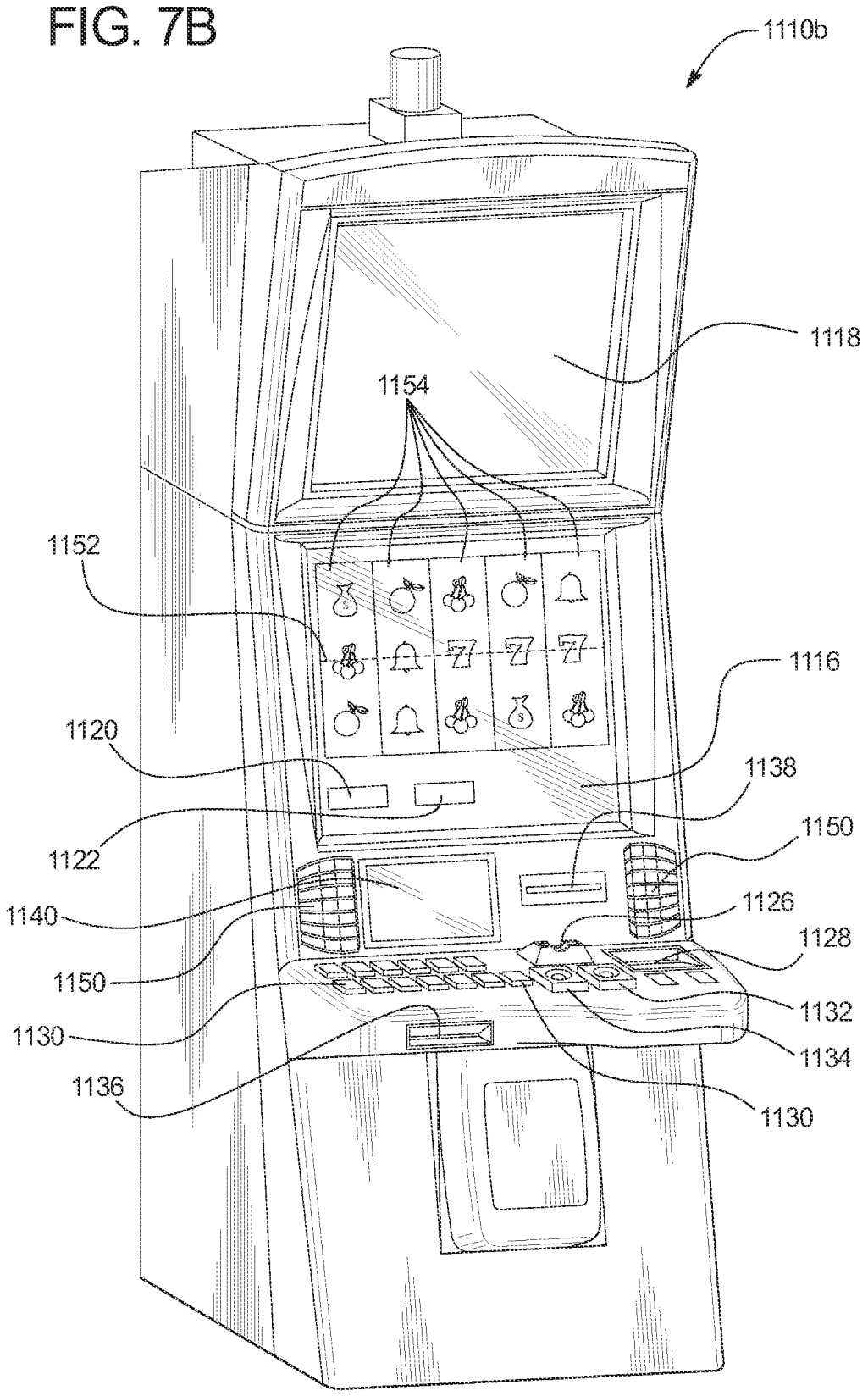

In various embodiments, the EGM includes one or more input devices. The input devices may include any suitable device that enables an input signal to be produced and received by the at least one processor of the EGM. The example EGM illustrated in FIG. 6B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 7A and 7B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 7A and 7B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 7A and 7B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 7A and 7B each include a card reader 1138. The card reader is configured to read a player identification card inserted into the card reader.

In various embodiments, the EGM includes one or more output devices. The example EGM illustrated in FIG. 6B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 6A includes a central display device 1116, a player tracking display 1140, a credit display 1120, and a bet display 1122. The example EGM illustrated in FIG. 6B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 7A and 7B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 7A and 7B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 7A and 7B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 7A and 7B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 7A and 7B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

at least one processor;

at least one display device supported by the housing;

a plurality of input devices supported by the housing and including an acceptor; and at least one memory device storing a plurality of instructions which, when executed by the at least one processor, cause the at least one processor to operate with the at least one display device and the plurality of input devices to:

(a) establish a credit balance based at least in part on a monetary value associated with a physical item responsive to the acceptor receiving the physical item;

(b) display a symbol display area matrix including a plurality of symbol display areas;

(c) place a wager on a play of a game associated with a plurality of symbols responsive to receipt of an actuation of a wager button, the credit balance decreasable by the wager;

(d) for the play of the game, randomly generate and display a plurality of the plurality of symbols at the plurality of symbol display areas of the symbol display area matrix;

(e) display a plurality of different paylines, each of the plurality of different displayed paylines being associated with a different plurality of the plurality of symbol display areas of the symbol display area matrix, the plurality of different displayed paylines including at least: (1) a first displayed payline associated with a first plurality of the plurality of symbol display areas of the symbol display area matrix, and (2) a second displayed payline associated with a second plurality of the plurality of symbol display areas of the symbol display area matrix, the first plurality of the plurality of symbol display areas of the symbol display area matrix not including any of the second plurality of the plurality of symbol display areas of the symbol display area matrix such that the first and second displayed paylines are non-overlapping;

(f) for each displayed payline, determine whether the symbols displayed at the symbol display areas of the symbol display area matrix associated with said displayed payline form one of a plurality of different winning symbol combinations, each winning symbol combination being associated with one of a plurality of different awards;

(g) when a plurality of instances of a first winning symbol combination are displayed in association a plurality of the paylines including the first and second non-overlapping paylines and at least one instance of a second different winning symbol combination is displayed in association with at least one of the paylines:

(A) during a first period, display a first group award presentation for all displayed instances of said first winning symbol combination, the displayed first group award presentation including a display of:

(i) a first award associated with said first winning symbol combination, the credit balance increasable by the first award, (ii) a total quantity of displayed instances of said first winning symbol combination, and (iii) a first indication of all displayed symbols that are part of at least one displayed instance of said first winning symbol combination;

(B) stop displaying the first group award presentation following expiration of the first period; and (C) during a second period after expiration of the first period, display a second group award presentation for all displayed instances of said second winning symbol combination, the displayed second group award presentation including a display of:

(i) a second award associated with said second winning symbol combination, the credit balance increasable by the second award, (ii) a total quantity of displayed instances of said second winning symbol combination, and (iii) a second indication of all displayed symbols that are part of at least one displayed instance of said second winning symbol combination; and (h) initiate a payout associated with the credit balance responsive to receipt of an actuation of a cashout button.

2. The gaming system of claim 1, wherein at least two of the plurality of different displayed paylines are associated with a same one of the plurality of symbol display areas of the symbol display area matrix such that said at least two paylines at least partially overlap.

3. The gaming system of claim 1, wherein the display of the first indication of all displayed symbols that are part of at least one displayed instance of said first winning symbol combination and the display of the second indication of all displayed symbols that are part of at least one displayed instance of said second winning symbol combination includes a border surrounding each said displayed symbol.

4. The gaming system of claim 1, wherein each of the plurality of different winning symbol combinations is associated with a different one of the plurality of different awards.

5. A method of operating a gaming system, said method comprising:

(a) receiving, by an acceptor, a physical item associated with a monetary value;

(b) establishing, by at least one processor, a credit balance based at least in part on the monetary value associated with the received physical item;

(c) displaying, by at least one display device, a symbol display area matrix including a plurality of symbol display areas;

(d) receiving an actuation of a wager button;

(e) placing, by the at least one processor, a wager on a play of a game associated with a plurality of symbols responsive to the received actuation of the wager button, the credit balance decreasable by the wager;

(f) for the play of the game, randomly generating, by the at least one processor, and displaying, by the at least one display device, a plurality of the plurality of symbols at the plurality of symbol display areas of the symbol display area matrix;

(g) displaying, by the at least one display device, a plurality of different paylines, each of the plurality of different displayed paylines being associated with a different plurality of the plurality of symbol display areas of the symbol display area matrix, the plurality of different displayed paylines including at least: (1) a first displayed payline associated with a first plurality of the plurality of symbol display areas of the symbol display area matrix, and (2) a second displayed payline associated with a second plurality of the plurality of symbol display areas of the symbol display area matrix, the first plurality of the plurality of symbol display areas of the symbol display area matrix not including any of the second plurality of the plurality of symbol display areas of the symbol display area matrix such that the first and second displayed paylines are non-overlapping;

(h) for each displayed payline, determining, by the at least one processor, whether the symbols displayed at the symbol display areas of the symbol display area matrix associated with said displayed payline form one of a plurality of different winning symbol combinations, each winning symbol combination being associated with one of a plurality of different awards;

(i) when a plurality of instances of a first winning symbol combination are displayed in association with a plurality of the paylines including the first and second non-overlapping paylines and at least one instance of a second different winning symbol combination is displayed in association with at least one of the paylines:

(A) during a first period, displaying, by the at least one display device, a first group award presentation for all displayed instances of said first winning symbol combination, the displayed first group award presentation including a display of:

(i) a first award associated with said first winning symbol combination, the credit balance increasable by the first award, (ii) a total quantity of displayed instances of said first winning symbol combination, and (iii) an indication of all displayed symbols that are part of at least one displayed instance of said first winning symbol combination;

(B) stop displaying, by the at least one display device, the first group award presentation following expiration of the first period; and (C) during a second period after expiration of the first period, displaying, by the at least one display device, a second group award presentation for all displayed instances of said second winning symbol combination, the displayed second group award presentation including a display of:

(i) a second award associated with said second winning symbol combination, the credit balance increasable by the second award, (ii) a total quantity of displayed instances of said second winning symbol combination, and (iii) a second indication of all displayed symbols that are part of at least one displayed instance of said second winning symbol combination;

(j) receiving an actuation of a cashout button; and (k) initiating, by the at least one processor, a payout responsive to the received actuation of the cashout button.

6. The method of claim 5, wherein at least two of the plurality of different displayed paylines are associated with a same one of the plurality of symbol display areas of the symbol display area matrix such that said at least two paylines at least partially overlap.

7. The method of claim 5, wherein the display of the first indication of all displayed symbols that are part of at least one displayed instance of said first winning symbol combination and the display of the second indication of all displayed symbols that are part of at least one displayed instance of said second winning symbol combination includes a border surrounding each said displayed symbol.

8. The method of claim 5, wherein each of the plurality of different winning symbol combinations is associated with a different one of the plurality of different awards.

9. The method of claim 5, which is at least partially provided through a data network.

10. The method of claim 9, wherein the data network is an internet.

* * * * *